US005603262A

United States Patent [19]

Uera et al.

[11] Patent Number: 5,603,262

[45] Date of Patent: Feb. 18, 1997

[54] INK-FURNISHING APPARATUS

[75] Inventors: Yoshinori Uera; Taiichi Ichizawa; Kohji Yoshizawa, all of Kawasaki; Takashi Iijima, Yokosuka, all of Japan

[73] Assignee: Kabushiki Kaisha Tokyo Kikai Seisakusho, Minato-Ku, Japan

[21] Appl. No.: 572,535

[22] Filed: Dec. 14, 1995

[30] Foreign Application Priority Data

Jun. 30, 1995 [JP] Japan ..... 7-188340

[51] Int. Cl.[6] ..... B41F 31/04; B41F 31/06

[52] U.S. Cl. ..... 101/350; 101/365

[58] Field of Search ..... 101/349, 350, 101/351, 352, 363, 364, 365, 207–210, 206, 147, 148, 157, 169; 118/258, 259, 261, 262, 263

[56] References Cited

U.S. PATENT DOCUMENTS

| | | | |
|---|---|---|---|
| 4,538,518 | 9/1985 | Dahlgren | 101/350 |
| 5,060,571 | 10/1991 | John | 101/350 |
| 5,357,864 | 10/1994 | Ohta et al. | 101/148 X |

FOREIGN PATENT DOCUMENTS

| | | |
|---|---|---|
| 1-93397 | 4/1989 | Japan . |
| 2-106350 | 4/1990 | Japan . |
| 2-122994 | 5/1990 | Japan . |
| 7-45244 | 5/1995 | Japan . |

*Primary Examiner*—J. Reed Fisher

*Attorney, Agent, or Firm*—Trexler, Bushnell, Giangiorgi & Blackstone, Ltd.

[57] ABSTRACT

An ink furnishing apparatus for a printing press for performing printing by furnishing an ink to a printing plate on a plate cylinder is selectively operable in an entire surface ink furnishing mode, in which a first gap is held fully opened, the doctor means is placed in contact with the metering roller, ink drawn through the fully opened first gap in a thickness corresponding to the first gap by rotation of the fountain roller, is furnished in an excess amount of ink onto the peripheral surface of the metering roller, the extra amount of ink on the peripheral surface is scraped off by means of the doctor means contacting with the peripheral surface of the metering roller to return to the ink fountain, and the ink is furnished onto a printing plate in a plate cylinder via the peripheral surface of the form roller in substantially uniform amount over the entire position along the axis of the metering roller, and in a local ink furnishing mode, in which the first gap is adjusted to be narrower with respect to divided divided zones by adjusting means, the doctor means is released away from the peripheral surface of the metering roller, the ink drawn from the ink fountain by rotation of the fountain roller per each separated zones in the desired thickness is furnished on the peripheral surface of the metering roller.

18 Claims, 24 Drawing Sheets

INK-FURNISHING APPARATUS

BACKGROUND OF THE INVENTION

1. Field of the Invention

The present invention relates generally to an ink furnishing apparatus for a printing press. More specifically, the invention relates to an ink furnishing apparatus, in which ink-furnishing is performed in a keyless ink furnishing mode, i.e. overall area ink-furnishing mode, for furnishing an ink adjusted into substantially uniform thickness on the overall surface of a printing plate, and a non-keyless ink furnishing mode, i.e. partial area ink-furnishing mode for furnishing an ink in an amount determined corresponding to an area of the image on the divided partial area of the printing plate divided along the axial direction of a plate cylinder, selectively. Also, the invention relates to an ink furnishing apparatus which is adapted to an ink having relatively high viscosity.

2. Description of the Related Art

As disclosed in Japanese Unexamined Patent Publication (Kokai) No. Heisei 1-93397, for example, the conventional keyless ink furnishing apparatus furnishes an ink over the entire surface of the printing plate in substantially uniformly by carrying the ink in an ink pan by rotating an ink fountain roller partially dipped in the ink within the ink pan, transferring the ink to a metering roller of downstream side, scraping out an excess amount of the ink by means of a doctor blade contacting on the peripheral surface of the metering roller to limit a furnishing ink amount in an amount determined by a capacity of a large number of metering cells (recesses) provided on the overall surface of the metering roller for furnishing substantially uniform amount of the ink.

On the other hand, Japanese Unexamined Patent Publication No. Heisei 2-106350 and Japanese Unexamined Patent Publication No. Heisei 2-122994 discloses another keyless ink furnishing apparatus different from the keyless ink furnishing apparatus disclosed in Japanese Unexamined Patent Publication No. Heisei 1-93397. However, as far as an ink furnishing apparatus carrying the ink stored in a storage means with the peripheral surface of the fountain roller by rotation thereof, is concerned, they have substantially the similar construction to Japanese Unexamined Patent Publication No. Heisei 1-93397 for carrying the ink upwardly from the ink storage means.

However, while the conventional keyless ink furnishing apparatus is adapted to low viscous ink, when high viscous ink is used, adhering ability of the ink on the peripheral surface of the fountain roller is low in comparison with the low viscous ink. Thus, amount of the ink carried upwardly with the peripheral surface of the fountain roller becomes insufficient to make it impossible to effectively furnish the ink.

Commonly owned Japanese Examined Patent Publication (Kokoku) No. Heisei 7-45244 proposes a high viscous ink adapted type keyless ink furnishing apparatus adapted to relatively high viscous ink, in which an ink contained in an ink fountain formed by a tilted plate and the periphery of the fountain roller, is carried out from a gap defined between the peripheral surface of the fountain roller and the lower end of the tilted plate by rotating the fountain roller.

However, the high viscous adapted type keyless ink furnishing apparatus sill hold problems, such as splashing of ink or so forth to be solved.

At first, splashing of ink is caused for opposite directions of rotation between the fountain roller and a downstream side roller to cause movement of the peripheral surfaces of the rollers in mutually opposite directions. When the ink is transferred between the peripheral surfaces of the rollers moving in opposite directions, splashing of the ink is caused. Particularly, higher rotation speed of the rollers results in greater ink splashing amount to lower ink furnishing efficiency and to stain the environment.

Next, when the high viscous ink adapted type keyless ink furnishing apparatus is applied to a lithographic press, in which printing is performed utilizing dampening water, the dampening water penetrates into an ink furnishing path. Since the apparatus has no mechanism for mixing the penetrated dampening water and the ink or mechanism for removing the mixture of the dampening water and the ink, the dampening water and ink are present in the ink furnishing apparatus in the separated condition. This water may be a cause of stripping of the roller to make ink furnishing impossible.

On the other hand, the most important advantage common to all of the keyless ink furnishing apparatus set forth above, i.e. the function for constantly furnishing of ink in substantially uniform thickness over the entire surface of the printing plate without adjustment by ink adjustment key, may serve as disadvantage for color printing by using of high viscous ink. Namely, in the current printing businesses, in the color printing utilizing relatively high viscous ink, it is frequently required to locally furnishing ink for quite limited portion on the printing surface as a spot color printing and is not required to furnish the ink over the entire printing surface. In such case, when the conventional keyless ink furnishing apparatus is used, the ink is inherently furnished even for the portion where furnishing of ink is not required. Therefore, large amount of ink should be wasted. Furthermore, furnishing the ink in the extra areas inherently require cleaning of unnecessarily large area to waste labour and time to degrade efficiency of printing operation.

In addition, there are demand for printing of special color other than three primary colors (yellow, cyan and magenta) or black with an ink having higher viscosity than the normal ink, for high quality printing superior in complexion and volume utilizing three primary color inks and/or black ink of higher viscosity than that of the normal ink. For performing printing with satisfying such demands, a printing facility for high quality printing becomes necessary for difficulty of application of a printing facility employing the conventional keyless ink furnishing. Therefore, in order to perform both paintings, it is required to have two kinds of mutually different printing facilities to be wasteful in viewpoint of installation space, investment for the apparatus.

SUMMARY OF THE INVENTION

It is an object of the present invention to eliminate the drawbacks in the prior art as set forth above.

Another and more specific object of the present invention is to provide an ink furnishing apparatus which permits use of high viscous ink having high viscosity in the extent that cannot be used in the prior art.

A further object of the present invention is to provide an ink furnishing apparatus which can operate under two mutually distinct ink furnishing modes, i.e. keyless ink furnishing mode and non-keyless ink furnishing mode.

A still further object of the present invention is to provide an ink furnishing apparatus which can avoid influence of a dampening water in application of a printing press using the dampening water.

A yet further object of the invention is to provide an ink furnishing apparatus, wherein, which is free from splashing of the ink and thus from causing stain of the environment.

According to the first aspect of the invention, an ink furnishing apparatus for a printing press for performing printing by furnishing an ink to a printing plate on a plate cylinder, comprises:

a form roller rotating in contact with a peripheral surface of the printing plate;

a rotatable metering roller having a peripheral surface contacting the upstream side of the peripheral surface of the form roller in the ink furnishing, and having a uniformly distributed large number of fine recesses on a peripheral surface thereof for receiving the ink;

doctor means for removing an extra amount of ink from the peripheral surface of the metering roller at a position upstream of the contacting position of the form roller, the doctor means having switching means for switching the position between a contacting position where the doctor means is in contact with the metering roller for effecting removal of the extra amount of the ink and a released position where the doctor means is shifted away from the metering roller;

an ink fountain opposing to the upper portion of the doctor means and opened at the front side and the upper side, and constituted of both side plates and tilted base;

a fountain roller having a peripheral surface located at a position for blocking the opened front side of the ink fountain, and positioned adjacent to a front edge of the ink fountain via a first gap, and positioned adjacent to the peripheral surface of the metering roller at an upstream position from the contacting position of the doctor means via a second gap which is smaller than the first gap, and the peripheral surface of said fountain roller blocking the front side of the ink fountain and rotatable downwardly at a peripheral speed lower than the peripheral speed of the metering roller; and first gap adjusting means separately provided in the ink fountain for respective adjustment of divided zones defined along an axial direction of the fountain roller for adjusting the first gap, the apparatus having means selectively operable in:

an entire surface ink furnishing mode, in which the first gap is held fully opened, the doctor means is placed in contact with the metering roller, ink drawn through the fully opened first gap in a thickness corresponding to the first gap by rotation of the fountain roller, is furnished in an excess amount of ink onto the peripheral surface of the metering roller, with compression by passing through the second gap, the extra amount of ink on the peripheral surface is scraped off by means of the doctor means contacting with the peripheral surface of the metering roller to return to the ink fountain, and the ink is furnished onto a printing plate on the plate cylinder via the peripheral surface of the form roller in substantially uniform amount over entire position along the axis of the metering roller, and a local ink furnishing mode, in which the first gap is adjusted to be narrower with respect to the divided zones by the adjusting means, the doctor means is released away from the peripheral surface of the metering roller, the ink drawn from the ink fountain by rotation of the fountain roller per each divided zones in the desired thickness is furnished on the peripheral surface of the metering roller in the amount corresponding to the thickness of the ink at each zone passed through the second gap, and the ink furnished on the peripheral surface of the metering roller is transferred to the printing plate on the plate cylinder via the peripheral surface of the form roller.

According to the second aspect of the invention, an ink furnishing apparatus for a printing press for performing printing by furnishing an ink to a printing plate on a plate cylinder, comprises:

a form roller rotating in contact with a peripheral surface of the printing plate;

a rotatable metering roller having a peripheral surface contacting at the upstream side of the peripheral surface of the form roller in the ink furnishing, and having a uniformly distributed large number of fine recesses on a peripheral surface thereof for receiving the ink;

doctor means for removing an extra amount of ink from the peripheral surface of the metering roller at a position upstream of the contacting position of the form roller, the doctor means having switching means for switching the position between a contacting position where the doctor means is in contact with the metering roller for effecting removal of the extra amount of the ink and a released position where the doctor means is shifted away from the metering roller;

a rider roller rotating with contacting with the peripheral surface of the metering roller at the downstream side of the contacting position between the form roller and the metering roller;

an ink fountain opposing to the upper portion of the doctor means and opened at the front side and the upper side, and constituted of both side plates and tilted base;

a fountain roller having a peripheral surface located at a position for blocking the opened front side of the ink fountain, and adjacent to a front edge of the ink fountain via a first gap, and positioned adjacent to the peripheral surface of the metering roller at an upstream position from the contacting position of the doctor means and the metering roller, and intermediate between the contacting position of said rider roller and the contacting position of said doctor means, via a second gap which is smaller than the first gap, and the peripheral surface of said fountain roller blocking the front side of the ink fountain and rotatable shifting downwardly at a peripheral speed lower than the peripheral speed of the metering roller; and first gap adjusting means separately provided in the ink fountain for respective of divided zones defined along an axial direction of the fountain roller for adjusting the first gap, the apparatus having means selectively operable in:

an entire surface ink furnishing mode, in which the first gap is held fully opened, the doctor means is placed in contact with the metering roller, ink drawn through the fully opened first gap in a thickness corresponding to the first gap by rotation of the fountain roller, is furnished an excess amount of ink onto the peripheral surface of the metering roller with compression by passing through the second gap, the extra amount of ink on the peripheral surface is scraped off by means of the doctor means contacting with the peripheral surface of the metering roller to return to the ink fountain, and the ink is furnished onto a printing plate on the plate cylinder via the peripheral surface of the form roller in substantially uniform amount over the entire position along the axis of the metering roller, and a local ink furnishing mode, in which the first gap is adjusted to be narrower to the necessary size with respect to the divided zones by the adjusting means, the doctor means is released away from the peripheral surface of the metering roller, the ink drawn from the ink fountain rotation of the fountain roller per each divided zones in the desired thickness is furnished on the peripheral surface of the metering roller in the amount corresponding to the thickness of the ink at each zone passed through the second gap, and the ink furnished on the peripheral surface of the metering roller is transferred to the printing plate on the plate cylinder via the peripheral surface of the form roller.

In the ink furnishing apparatus according to the foregoing first and second aspect of the invention, the fine recesses of the metering roller include regularly provided cavities on the peripheral surface, or in the alternative, comprise cavities opening hollow portions on the peripheral surface formed by uniformly dispersing in an outer peripheral layer. Also, the doctor mean may be a doctor blade, a doctor bar, a doctor roller having means adapted to rotate said doctor roller at a lower peripheral speed than a peripheral speed of the metering roller, or a doctor roller rotating said doctor roller in a direction where the peripheral surface of the doctor roller displaces in an opposite direction to the displacement of the peripheral surface of the metering roller.

The foregoing second aspect of the ink furnishing apparatus may further comprise another rotatable roller contacting on the peripheral surface of the rider roller.

According to the third aspect of the invention, an ink furnishing apparatus for a printing press for performing printing by furnishing an ink to a printing plate on a plate cylinder, comprises:

a form roller rotating in contact with a peripheral surface of the printing plate;

a rotatable metering roller having a peripheral surface contacting at the upstream side of the peripheral surface of the form roller in the ink furnishing, and having a uniformly distributed large number of fine recesses on a peripheral surface thereof for receiving the ink;

doctor roller rotating in contact with the upstream peripheral surface upstream of the form roller in ink furnishing, and having means for selectively switching between rotation for scraping the ink off the peripheral surface of the metering roller and not scraping the ink;

an ink fountain opposing to the upper portion of the doctor roller and opened at the front side and the upper side, and include both side plates and tilted base;

a fountain roller having a peripheral surface located at a position for blocking the opened front side of the ink fountain, and positioned adjacent to a front edge of the ink fountain via a first gap, and position adjacent to the peripheral surface of the metering roller at an upstream position from the contacting position of the doctor roller via a second gap which is smaller than the first gap, and the peripheral surface of said fountain roller blocking the front side of the ink fountain and rotatable downwardly at a peripheral speed lower than the a peripheral speed of the metering roller; and first gap adjusting means separately provided in the ink fountain for respective adjustment of divided zones defined along an axial direction of the fountain roller for adjusting the first gap, the apparatus having means selectively operable in:

an entire surface ink furnishing mode, in which the first gap is held fully opened, the doctor roller is placed in rotation for scraping off the ink from the peripheral surface of the metering roller, ink drawn through the fully opened first gap in a thickness corresponding to the first gap by rotation of the fountain roller, is furnished in an excess amount of ink onto the peripheral surface of the metering roller, with compression by passing through the second gap, the extra amount of ink on the peripheral surface is scraped off by means of the doctor roller rotating for scraping off the ink from the peripheral surface of the metering roller to return to the ink fountain, and the ink is furnished onto a printing plate on the plate cylinder via the peripheral surface of the form roller in substantially uniform amount over the entire position along the axis of the metering roller, and a local ink furnishing mode, in which the first gap is adjusted to be narrower with respect to the divided zones by the adjusting means, the doctor roller is rotated not to scrape off the ink from the peripheral surface of the metering roller, the ink drawn from the ink fountain by rotation of the fountain roller per each divided zone in the desired thickness is furnished on the peripheral surface of the metering roller in the amount corresponding to the thickness of the ink at each zone passed through the second gap, and the ink furnished on the peripheral surface of the metering roller is transferred to the printing plate on the plate cylinder via the peripheral surface of the form roller.

According to the fourth aspect of the invention, an ink furnishing apparatus for a printing press for performing printing by furnishing an ink to a printing plate on a plate cylinder, comprises:

a form roller rotating in contact with a peripheral surface of the printing plate;

a rotatable metering roller a peripheral surface contacting at the upstream side of the peripheral surface of the form roller in the ink furnishing, and having a uniformly distributed large number of fine recesses on a peripheral surface thereof for receiving the ink;

doctor roller rotating with contacting with the peripheral surface upstream of the form roller in ink furnishing, and having means for selectively switching between rotation for scraping the ink off the peripheral surface of the metering roller and not scraping the ink;

a rider roller rotating with contacting with the peripheral surface of the metering roller at the position downstream side of the contacting position between the form roller and the metering roller;

an ink fountain opposing to the upper portion of the doctor roller and opened at the front side and the upper side, and constituted of both side plates and tilted base;

a fountain roller having a peripheral surface located at a position for blocking the opened front side of the ink fountain, and positioned adjacent to a front edge of the ink fountain via a first gap, and positioned adjacent to the peripheral surface of the metering roller at an upstream position from the contacting position of the doctor roller and intermediate between the contacting position of the rider roller and the contacting position of the doctor rollers via a second gap which is smaller than the first gap, and the peripheral surface of said fountain roller blocking the front side of the ink fountain and rotatable shifting downwardly at a peripheral speed lower than the peripheral speed of the metering roller; and first gap adjusting means separately provided in the ink fountain for respective of divided zones defined along an axial direction of the fountain roller for adjusting the first gap, the apparatus having means selectively operable in:

an entire surface ink furnishing mode, in which the first gap is held fully opened, the doctor roller is placed in rotation for scraping off the ink from the peripheral surface of the metering roller, ink drawn through the fully opened first gap in a thickness corresponding to the first gap by rotation of the fountain roller, is furnished in an excess amount of ink onto the peripheral surface of the metering roller, with compression by passing through the second gap, the extra amount of ink on the peripheral surface is scraped off by means of the doctor roller rotating for scraping off the ink from the peripheral surface of the metering roller to return to the ink fountain, and the ink is furnished onto a printing plate on the plate cylinder via the peripheral surface of the form roller in substantially uniform amount over entire position along the axis of the metering roller, and a local ink furnishing mode, in which the first gap is adjusted to be narrower with respect to the divided zones by the adjusting means, the doctor roller is rotated not to scrape off the ink from the peripheral surface of the metering roller, the ink drawn from the ink fountain by rotation of the fountain roller per each divided zone in the desired thickness is furnished on the peripheral surface of the metering roller in the amount corresponding to the thickness of the ink at each zone passed through the second gap, and the ink furnished on the peripheral surface of the metering roller is transferred to the printing plate on the plate cylinder via the peripheral surface of the form roller.

In the ink furnishing apparatus according to the foregoing third and fourth aspect of the invention, the fine recesses of the metering roller are constituted of regularly provided cavities on the peripheral surface, or in the alternative, constituted of cavities opening hollow portions on the peripheral surface formed by uniformly dispersing in an outer peripheral layer. Also, the rotation of the doctor roller when not scraping off the ink from the peripheral surface of the metering roller is in a idling rotation by a frictional force in contact with the metering roller, means for rotating said doctor roller of a peripheral speed substantially equal to the peripheral speed of the metering roller in the same direction as the peripheral surface of said metering roller when scraping the ink from the peripheral surface of said metering roller includes means for rotating said doctor roller at a peripheral speed which is lower than the peripheral speed of the metering roller or powered rotation, in which the peripheral surface of the doctor roller in opposite direction to the displacement of the peripheral surface of the metering roller.

The foregoing fourth aspect of the ink furnishing apparatus may further comprise another rotatable roller contacting with the peripheral surface of the rider roller.

In the operation of the ink furnishing apparatus according to the present invention constructed as set forth above, at first, when the high viscous ink is filled in the ink fountain, despite of the fact that the first gap is formed between the front edge of the bottom portion of the ink fountain and the peripheral surface of the fountain roller, the ink is stored in the ink fountain without flowing out through the first gap by its own deformation, low flow ability.

Then, by rotating the fountain roller to cause downward movement of the peripheral surface blocking the opened front side of the ink fountain, the ink adhering on the peripheral surface of the fountain roller by its own viscosity is drawn to cause displacement. As a result, the ink is drawn out of the ink fountain with being extended in a thickness to pass through the first gap.

Thus, by continuous rotation of the fountain roller, the high viscous ink in the ink fountain is drawn in the uniform thickness from the ink fountain with adhering on the peripheral surface of the fountain roller to reach the second gap defined between the peripheral surface of the fountain roller and the peripheral surface of the metering roller. The second gap is smaller than the first gap. Accordingly, the ink adhering on the peripheral surface of the fountain ink is further compressed to be thinner through the second gap and depressed onto the metering roller. At this time, the external acting on the ink causes temporary softening of the ink to temporarily increase flow ability of the ink.

The ink thus transferred to the peripheral surface of the metering roller is transferred to the contact position of the doctor means by rotation of the metering roller. Then, the extra amount of ink is scraped off by the doctor means from the peripheral surface of the metering roller. The scraped ink is collected in the upwardly opened ink fountain located below the doctor means.

As the doctor means, a scraper type doctor means having a fixed contacting portion to contact with the peripheral surface of the metering roller, such as the doctor blade, the doctor bar, and a rotary type doctor means having rotating contact portion to contact with the peripheral surface of the metering roller, such as the doctor roller. The doctor roller rotates at lower peripheral speed than that of the metering roller, or, in the alternative to rotate in the opposite direction to shift the peripheral surface at the contacting position in the direction opposite to the motion direction of the peripheral surface of the metering roller for scraping off the ink.

When the later rotary type doctor means is employed, utilizing elastic hydro lubrication phenomenon, the ink amount to be retained on the periphery of the metering roller can be adjusted. By this, the printing density of the overall printing surface becomes possible.

The ink on the peripheral surface of the metering roller after scraping off the extra amount of the ink by the doctor means reaches the contacting position with the form roller according to rotation of the metering roller to be transferred to the peripheral surface of the form roller. The ink carried on the peripheral surface of the form roller reaches the contacting position with the printing plate by rotation of the form roller. Thus, ink is furnished onto the overall surface of the printing plate in substantially equal thickness.

The peripheral surface at the down stream of the form roller after contacting with the printing plate differentiates the thickness of the remaining ink at the portion where ink is supplied to the image portion and the portion where ink is not supplied, at a timing immediately after transfer of the ink. However, by subsequent rotation, in the similar operation to those set forth above, the ink in the amount compensating the thickness difference is supplied. Thus ink furnishing to the printing plate and supply of the ink from the metering roller is sequentially repeated.

It should be noted that the metering roller and the form roller in ink furnishing are driven at substantially equal peripheral speed to the peripheral speed of the printing plate on the plate cylinder. Also, the peripheral surfaces of the contacting two rollers shifts in the same direction at the contacting portion. By this, ink furnishing or supply to the downstream can be smoothly performed to successfully prevent unnecessary wearing of the rollers or generation of the resistance heat.

Next, in the case of printing requiring ink furnishing for entire area of the printing plate uniformly, or printing which can be done by ink furnishing for entire area of the printing plate uniformly, the print can be performed with the keyless ink furnishing mode. On the other hand, in case of printing, in which keyless ink furnishing should cause waste of ink in significant amount or difficulty or not be suitable, the ink furnishing mode is switched into the non-keyless ink furnishing mode.

Namely, in case of the first and second aspect of the invention, by contacting of the doctor means onto the peripheral surface of the metering roller and in case of the third to fourth aspect of the invention, by switching the rotation mode of the doctor roller from the rotation not scraping the ink to the rotation scraping off the ink, the extra amount of ink on the peripheral surface of the metering roller. In either case, by operating in the condition where the first gap adjusting means provided in the ink fountain is placed in fully open position, the ink can always be furnished uniformly over the entire surface of the printing plate.

On the other hand, by shifting the doctor means away from the peripheral surface of the metering roller in the case of the first and second aspect of the invention, and by switching operation mode of the doctor roller from the rotation for scraping off the ink to the rotation not scraping the ink, and in conjunction therewith by adjusting the first gap per respective of divided zones along the axial direction of the fountain roller by the first gap adjusting means provided in the ink fountain, adapting to the distribution of the image on the printing plate surface, necessary amount of ink can be furnished for desired portion of the printing plate.

In order to shut off ink furnishing from the fountain roller to the metering roller with respect to the zone which is not required to furnish the ink, the first gas defined by the front edge of the base of the ink fountain and the peripheral surface of the fountain roller is adjusted to be smaller than the second gap between the fountain roller and the metering roller by the first gap adjusting means.

On the other hand, for furnishing the ink only for the limited separated zone, the ink fountain is divided into a plurality of zones corresponding to the separated zones and the ink is filled only in the divided zones corresponding to the separated zone requiring furnishing of the ink.

In the third to fourth aspect of the invention, when the doctor roller is driven to cause rotation in the mode not to scrape off the ink from the peripheral surface of the metering roller, the doctor roller may serve as a rider roller providing depression force for the ink on the peripheral surface of the metering roller to cause disrupter of the ink.

On the other hand in the second and fourth aspect of the invention, the rider roller contacts with the peripheral surface of the metering roller at the position downstream side of the contacting position between the peripheral surface of the metering roller and the form roller to load a pressure on the ink carried on the peripheral surface of the metering roller at its contacting position to cause disrupter of the ink. By this the flow ability of the ink can be temporarily increased. By continuing this through out printing operation, the flow ability of the overall ink in the ink furnishing apparatus can be gradually increased.

The ink furnishing apparatus according to the invention is implemented in the lithographic printing press performing printing utilizing the dampening water, the rider roller acts on the dampening water penetrating into the ink furnishing apparatus via the peripheral surface of the form roller from the non image forming portion of the printing plate to load a pressure at the contacting position with the metering roller. By exertion of pressure onto the dampening water, the dampening water is forcedly mixed with the ink and dispersed therein. Also, it is formed into thin film on both of the peripheral surface of the metering roller and the peripheral surface of the rider roller per se. The rider roller or the peripheral surface of the roller contacting thereof generates a heat on the peripheral surface by repeated contact with elastic deformation by contact. By this heat, the dampening water in a form of thin film can be promoted to evaporate. Thus, the dampening water can be successfully removed from the ink furnishing apparatus.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

Figure 1:
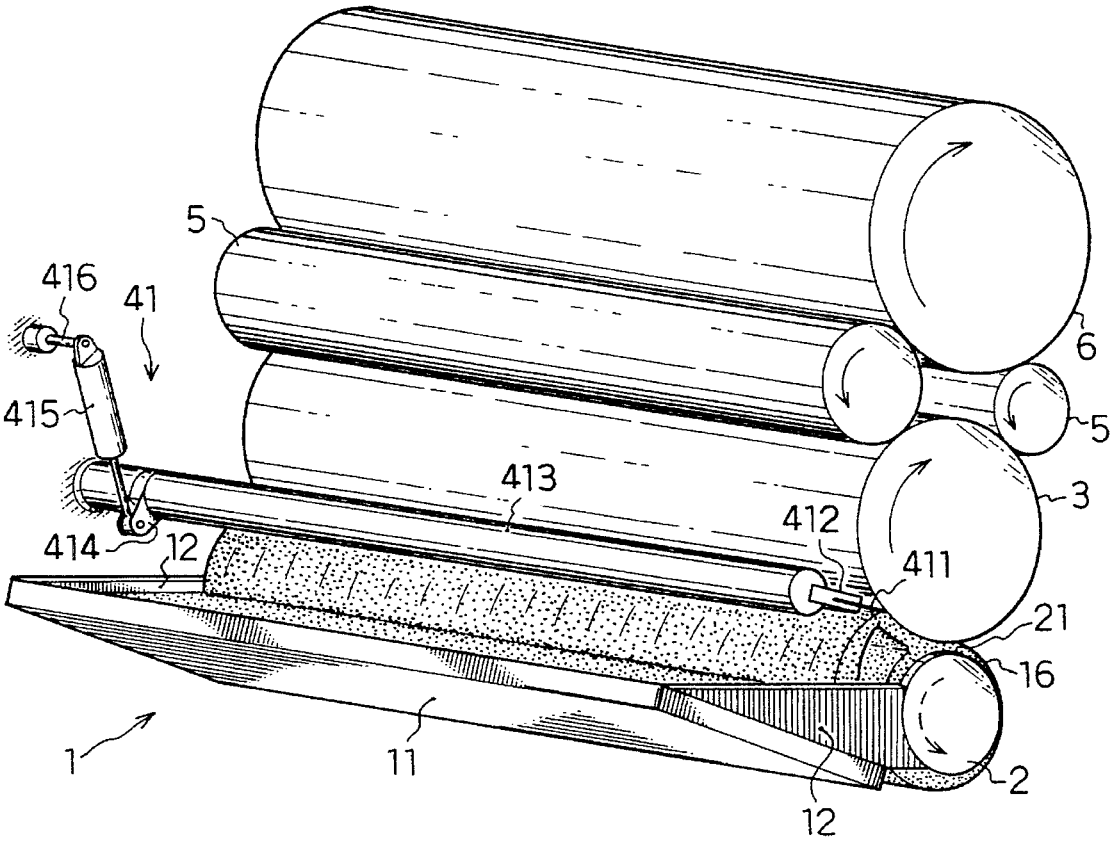
FIG. 1 is a perspective view showing general construction of the first embodiment of an ink furnishing apparatus according to the present invention.

An ink furnishing apparatus according to the present invention will be discussed hereinafter in detail in terms of the preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention. It should be further noted that the structures, elements, components common in two or more embodiments discussed hereinafter will be represented by the same reference numerals and redundant discussion will be avoided to keep the disclosure simple enough to facilitate clear understanding of the present invention.

Figure 2:
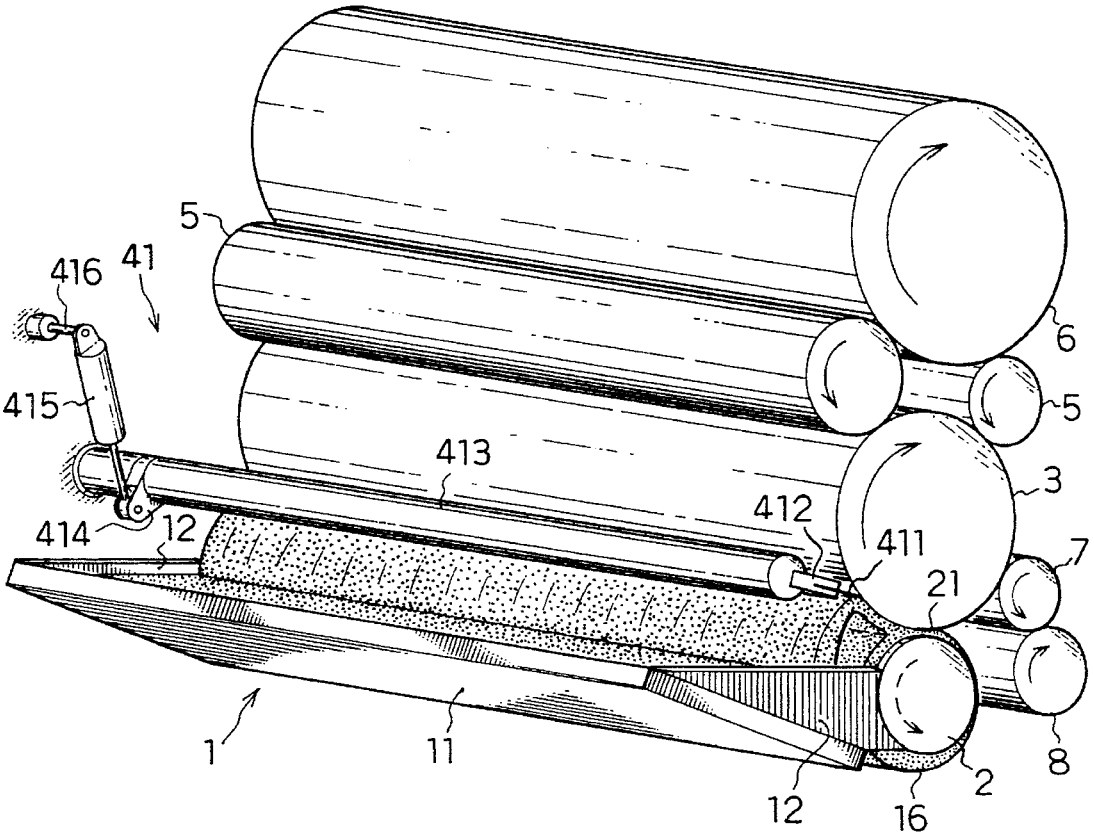
FIG. 2 is a perspective view showing a general construction of the second embodiment of an ink furnishing apparatus according to the present invention.
Figure 3:
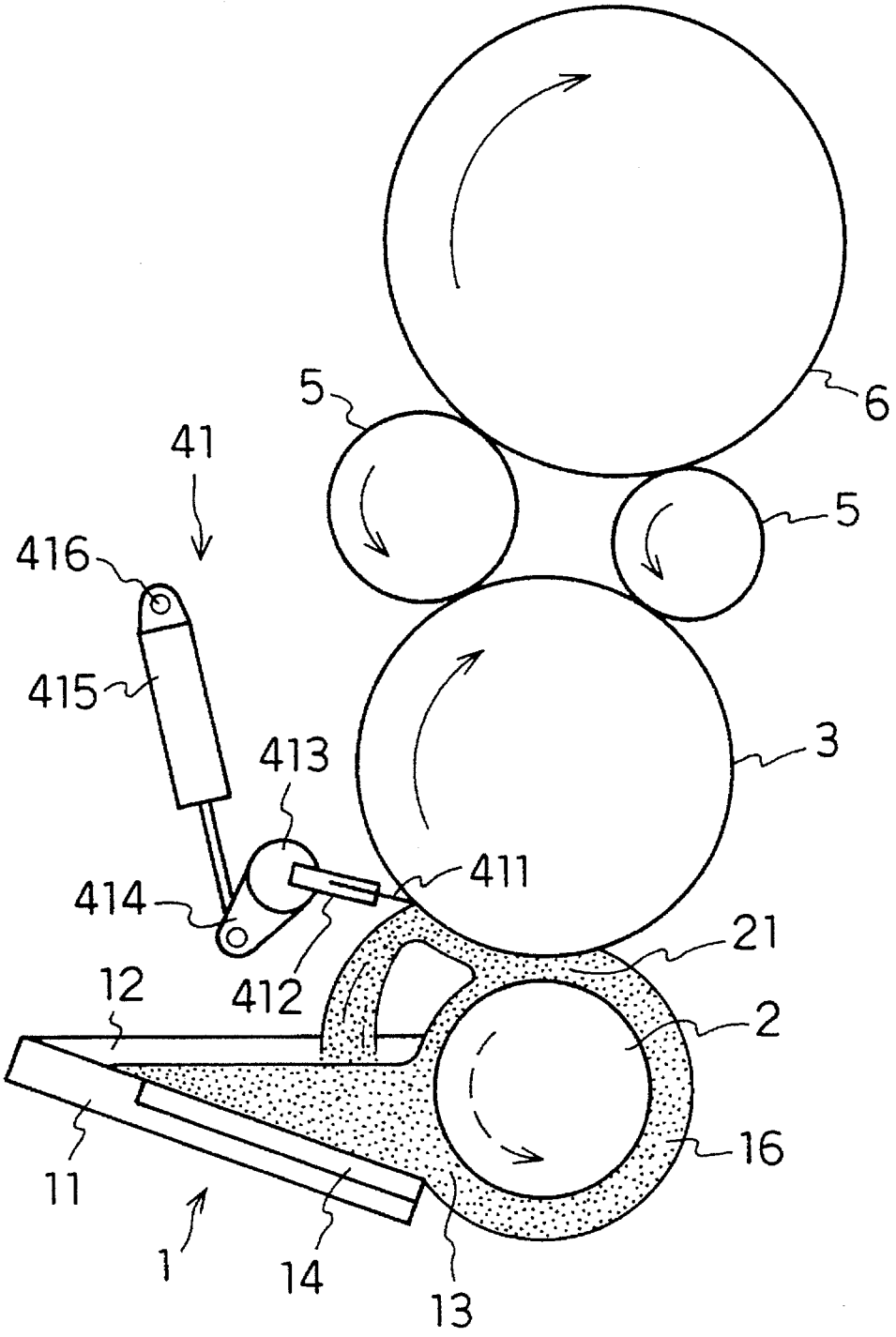
FIG. 3 is a sectional side elevation of the first embodiment of the ink furnishing apparatus in keyless ink furnishing mode.
Figure 4:
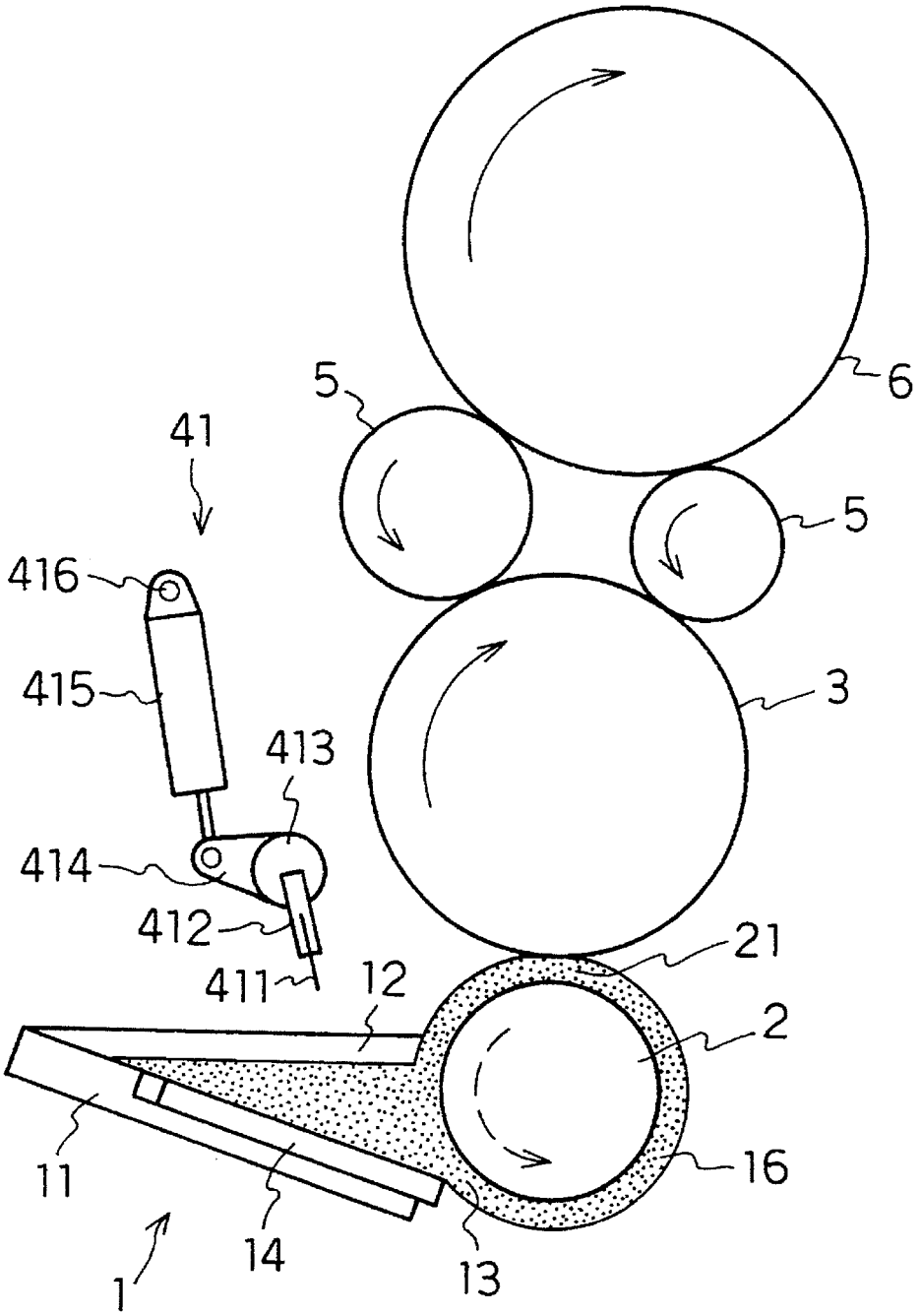
FIG. 4 is a sectional side elevation of the first embodiment of the ink furnishing apparatus in non-keyless ink furnishing mode.
Figure 5:
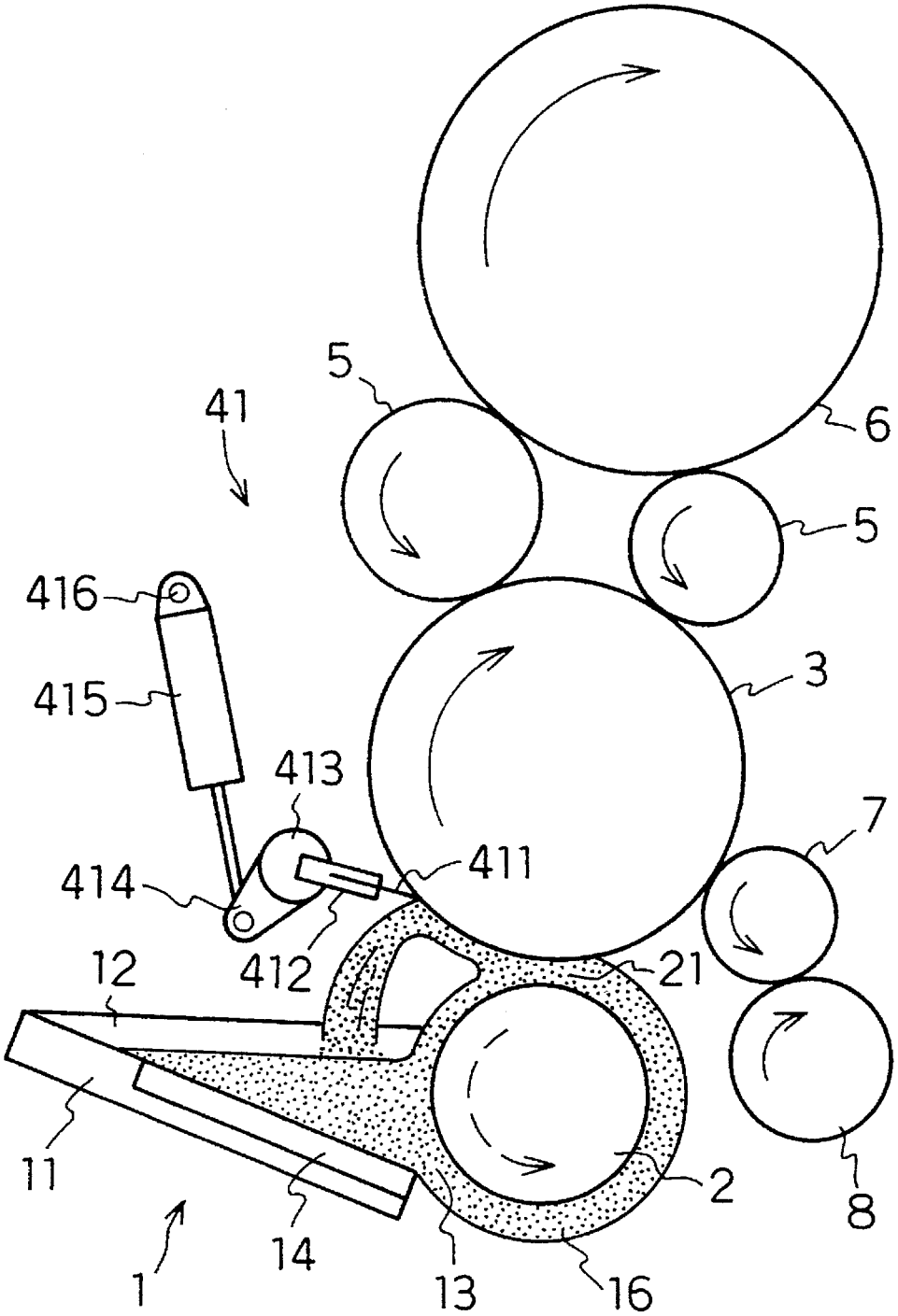
FIG. 5 is a sectional side elevation of the second embodiment of the ink furnishing apparatus in keyless ink furnishing mode.
Figure 6:
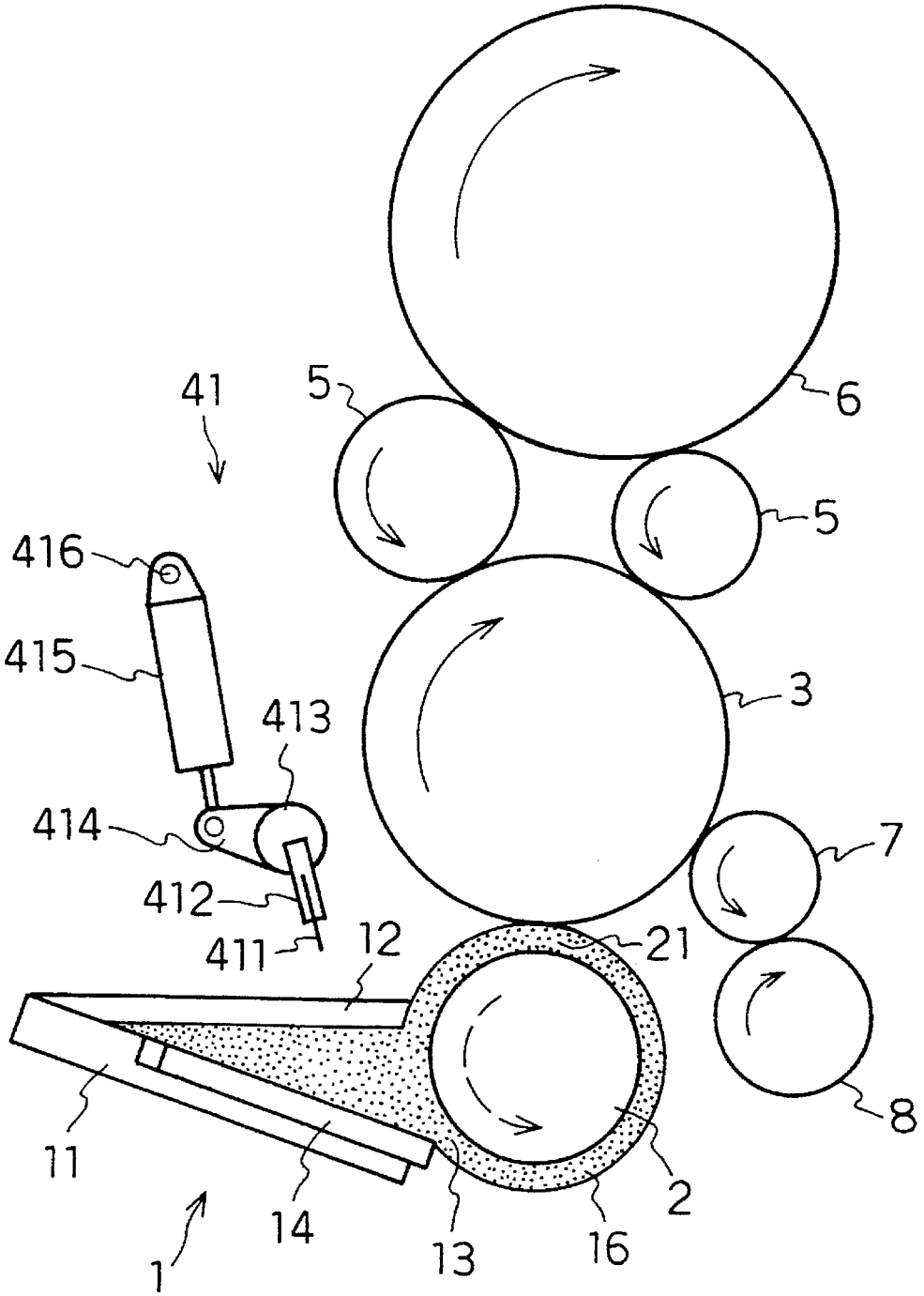
FIG. 6 is a sectional side elevation of the second embodiment of the ink furnishing apparatus in non-keyless ink furnishing mode.
Figure 7:
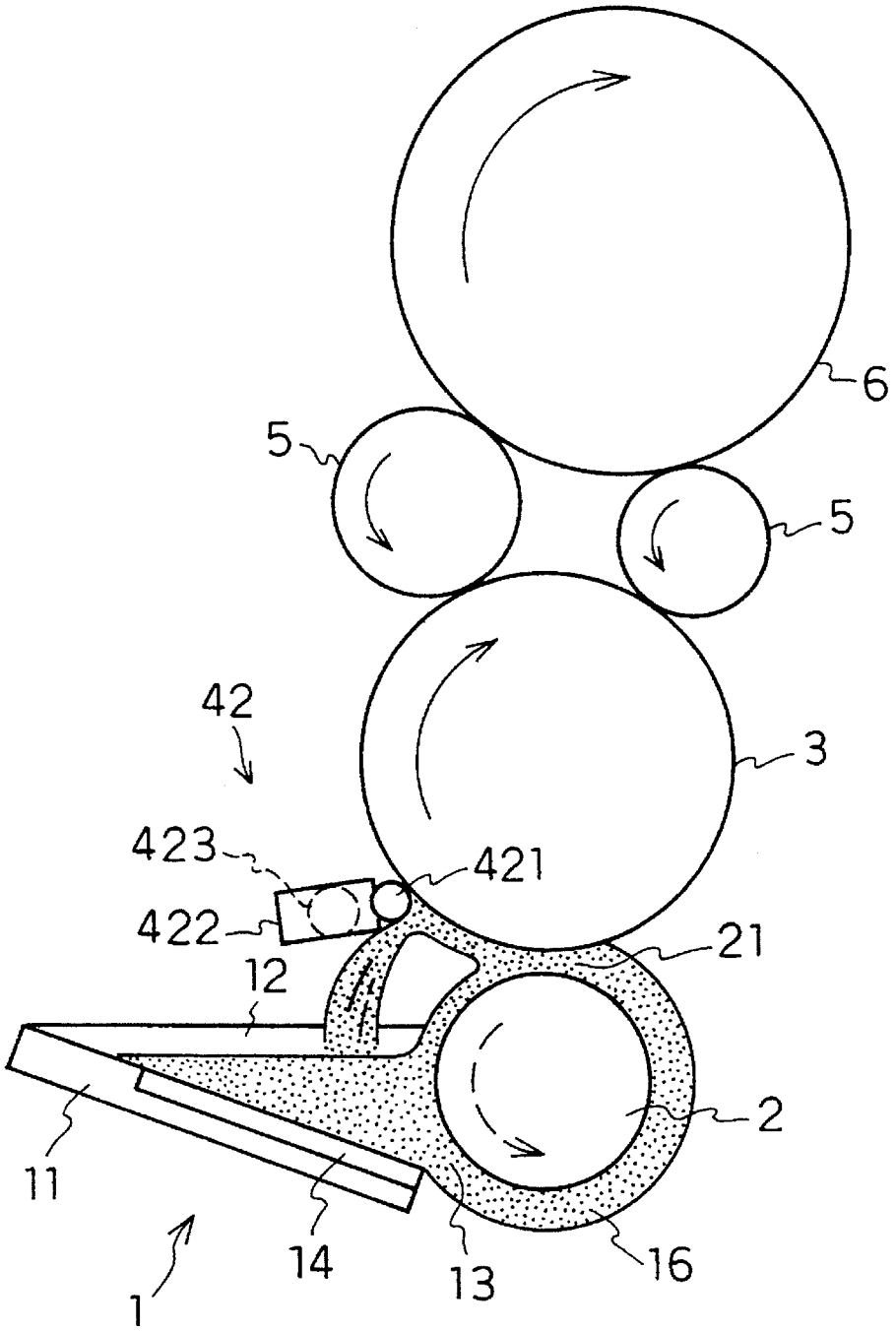
FIG. 7 is a sectional side elevation of a modification of the first embodiment of the ink furnishing apparatus in keyless ink furnishing mode.
Figure 8:
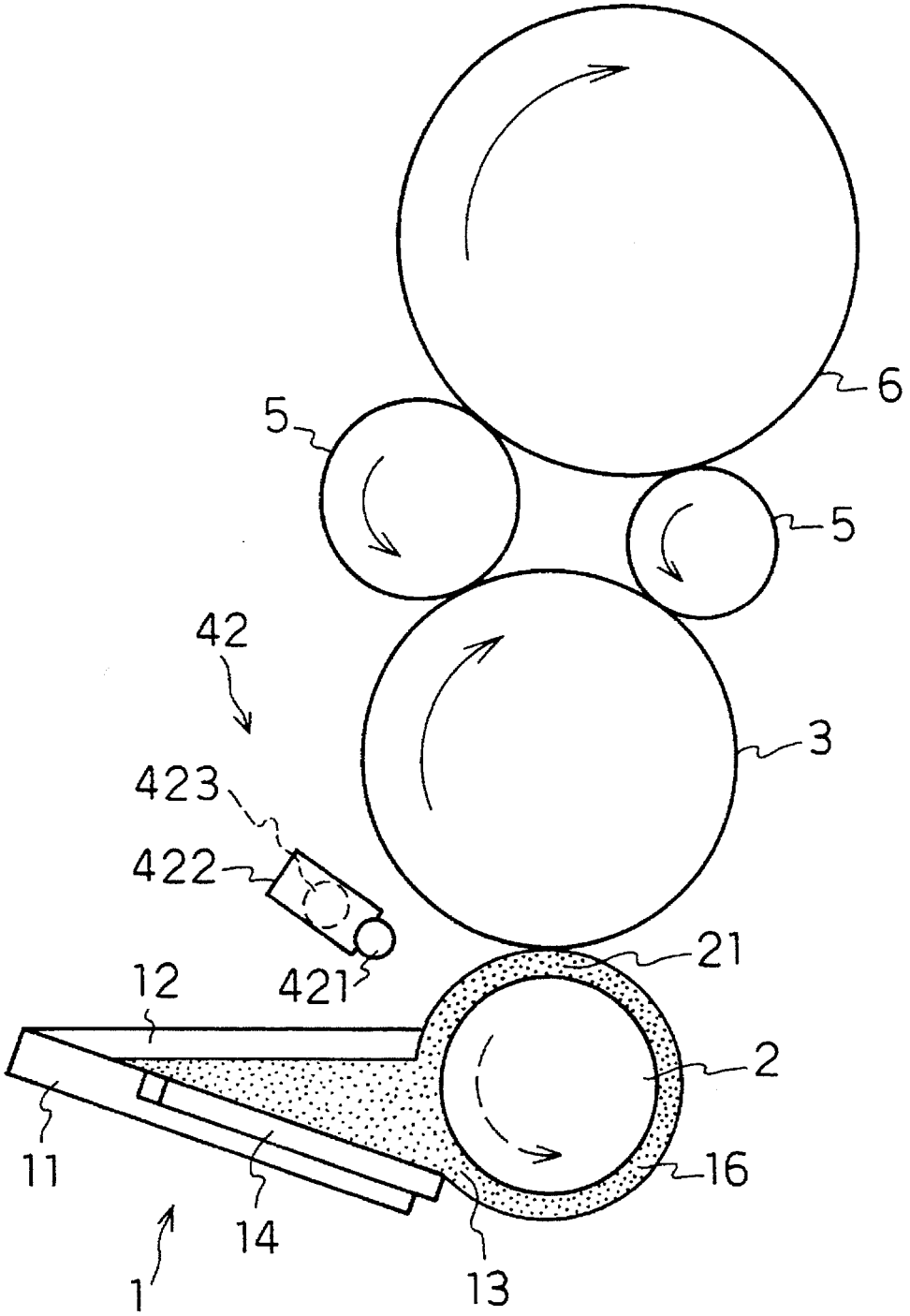
FIG. 8 is a sectional side elevation of a modification of the first embodiment of the ink furnishing apparatus in non-keyless ink furnishing mode.
Figure 9:
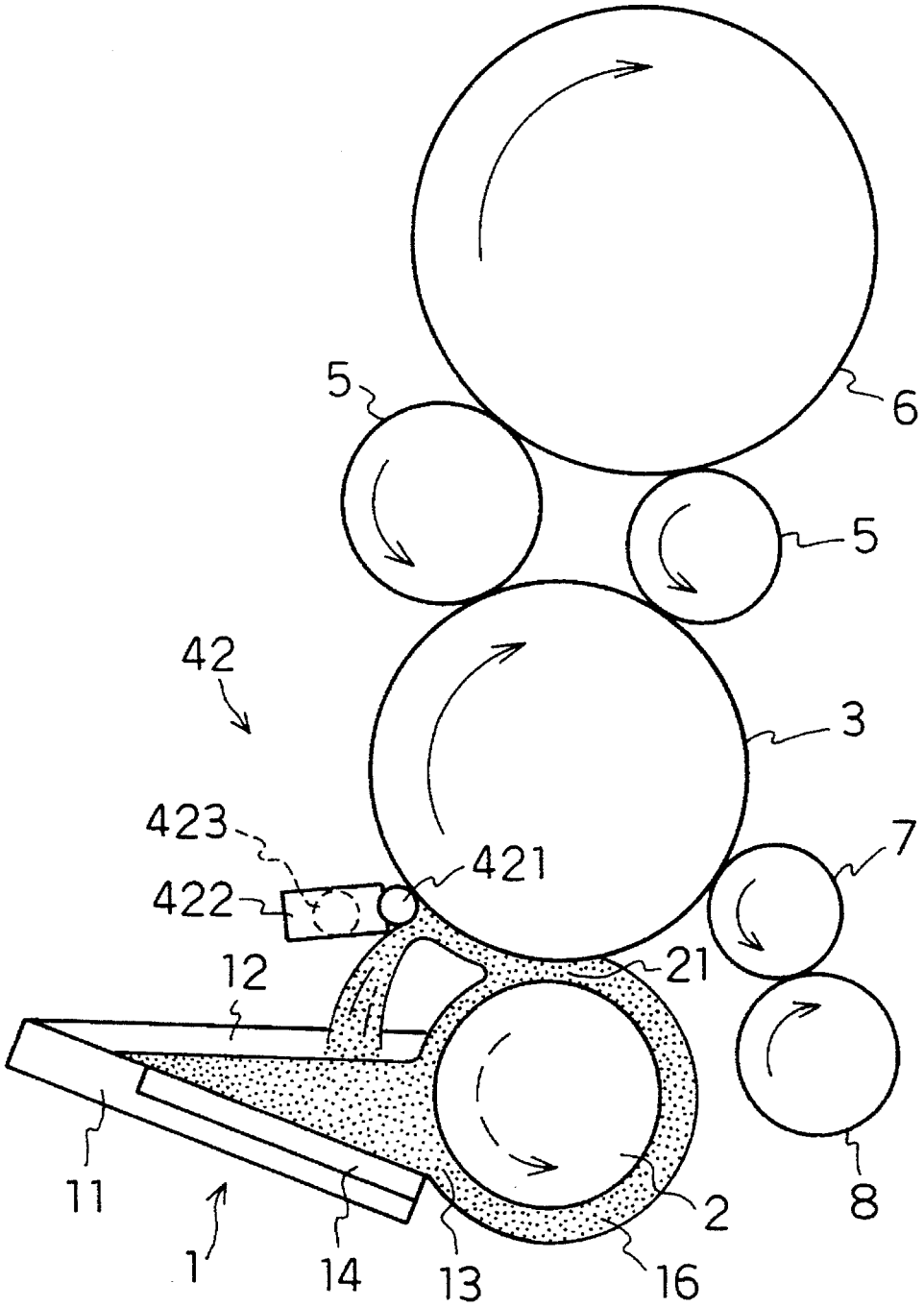
FIG. 9 is a sectional side elevation of a modification of the second embodiment of the ink furnishing apparatus in keyless ink furnishing mode.
Figure 10:
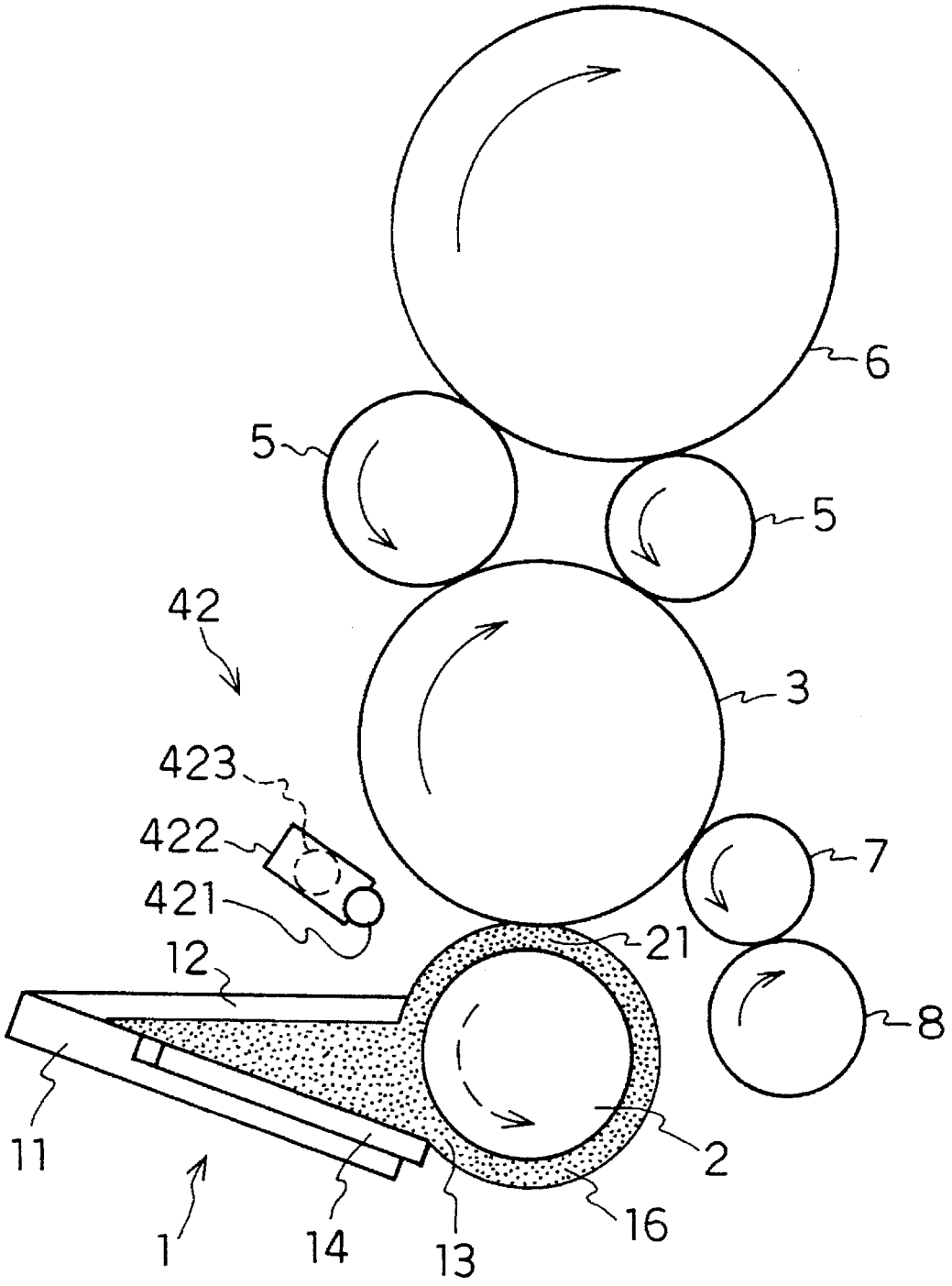
FIG. 10 is a sectional side elevation of the modification of the second embodiment of the ink furnishing apparatus in non-keyless ink furnishing mode.
Figure 11:
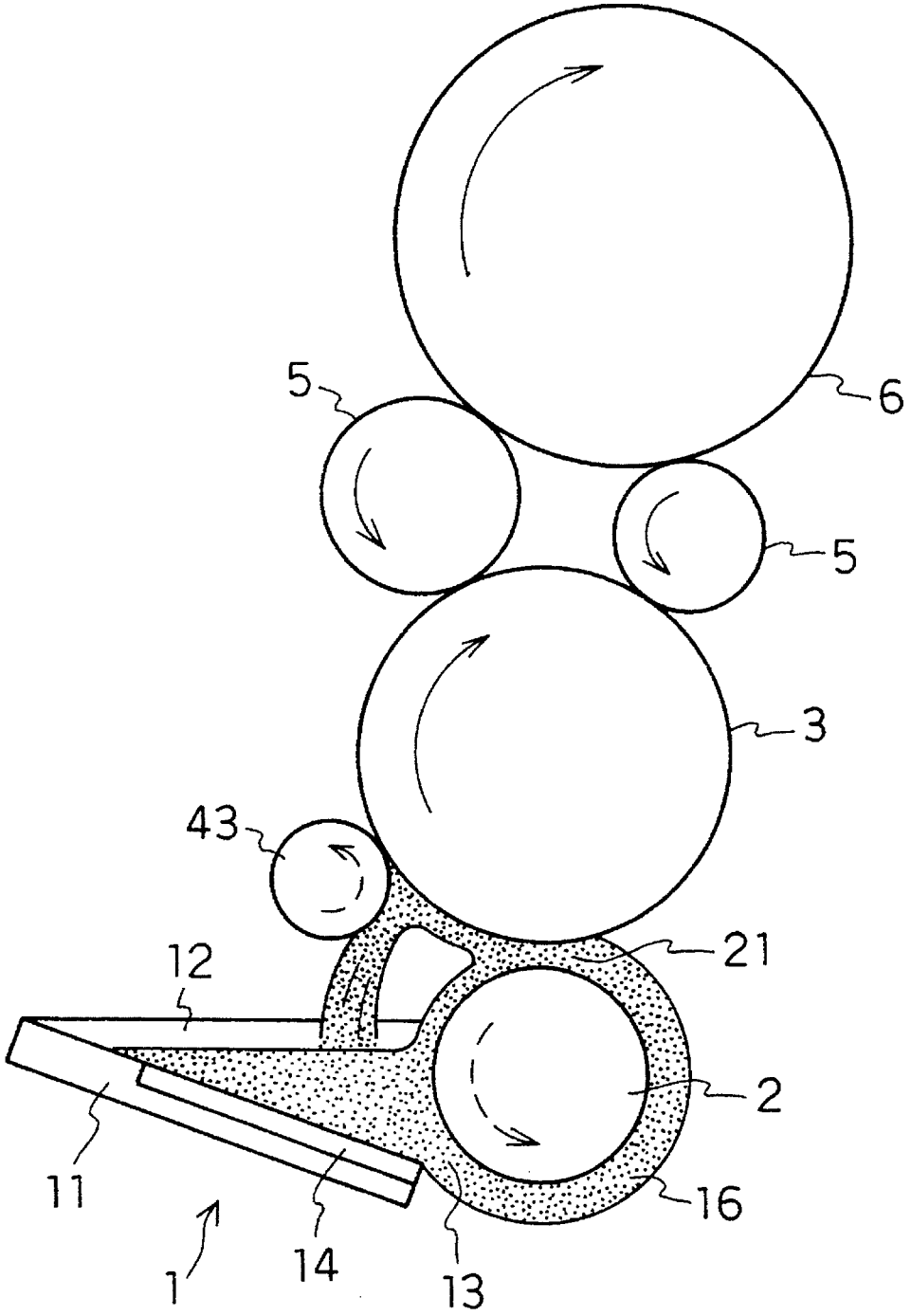
FIG. 11 is a sectional side elevation of another modification of the first embodiment of the ink furnishing apparatus in keyless ink furnishing mode.
Figure 12:
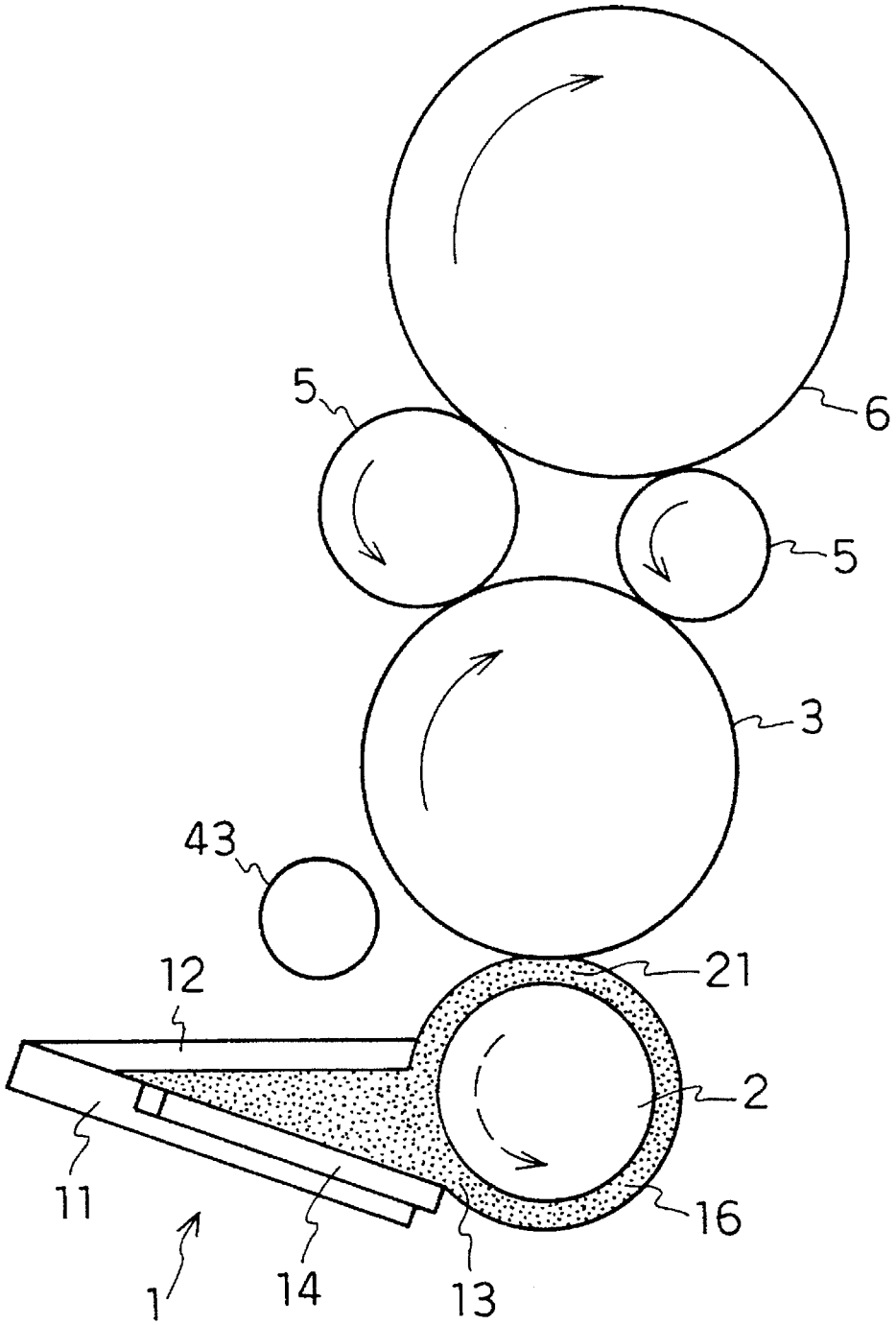
FIG. 12 is a sectional side elevation of another modification of the first embodiment of the ink furnishing apparatus in non-keyless ink furnishing mode.
Figure 13:
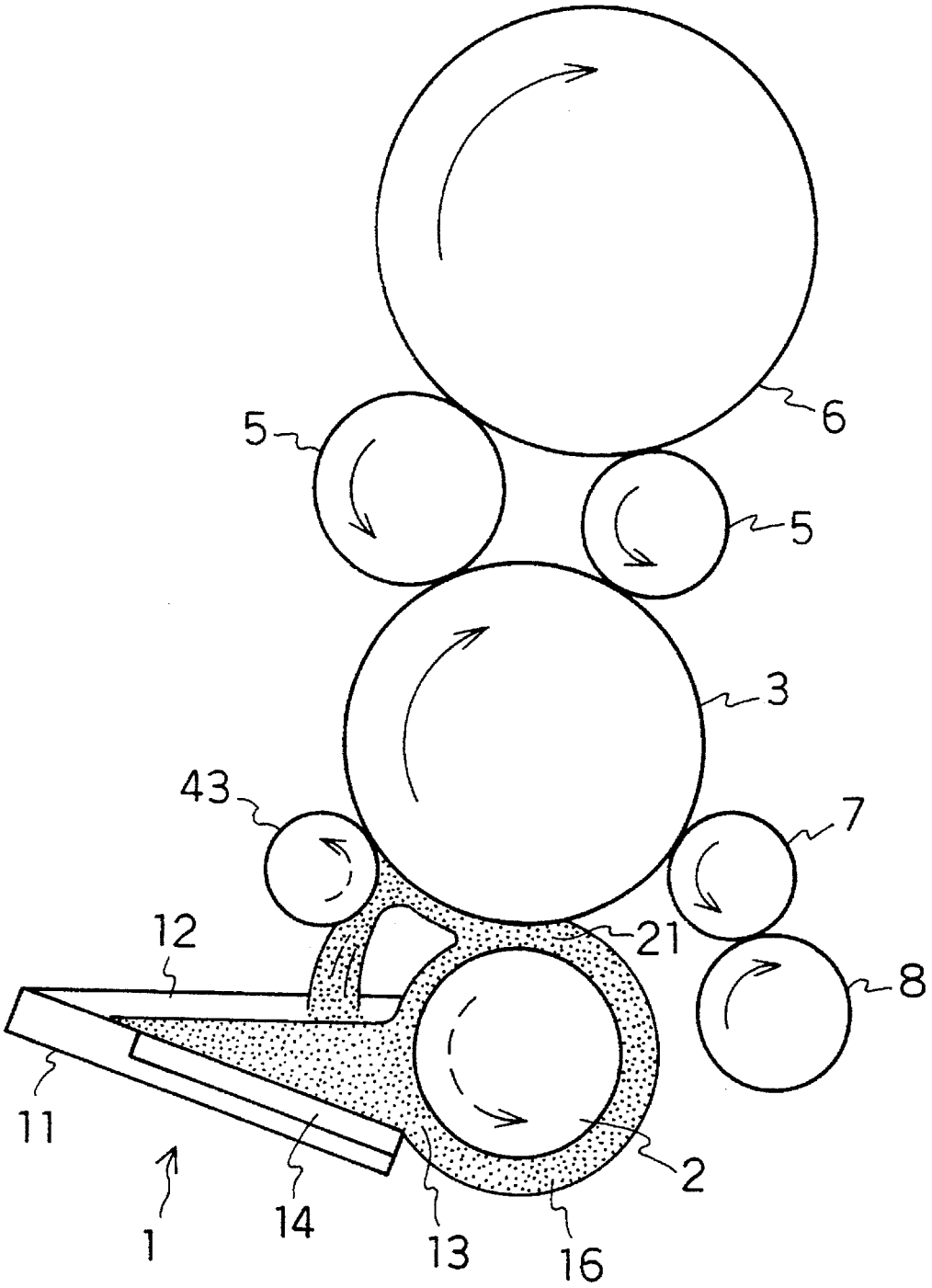
FIG. 13 is a sectional side elevation of another modification of the second embodiment of the ink furnishing apparatus in keyless ink furnishing mode.
Figure 14:
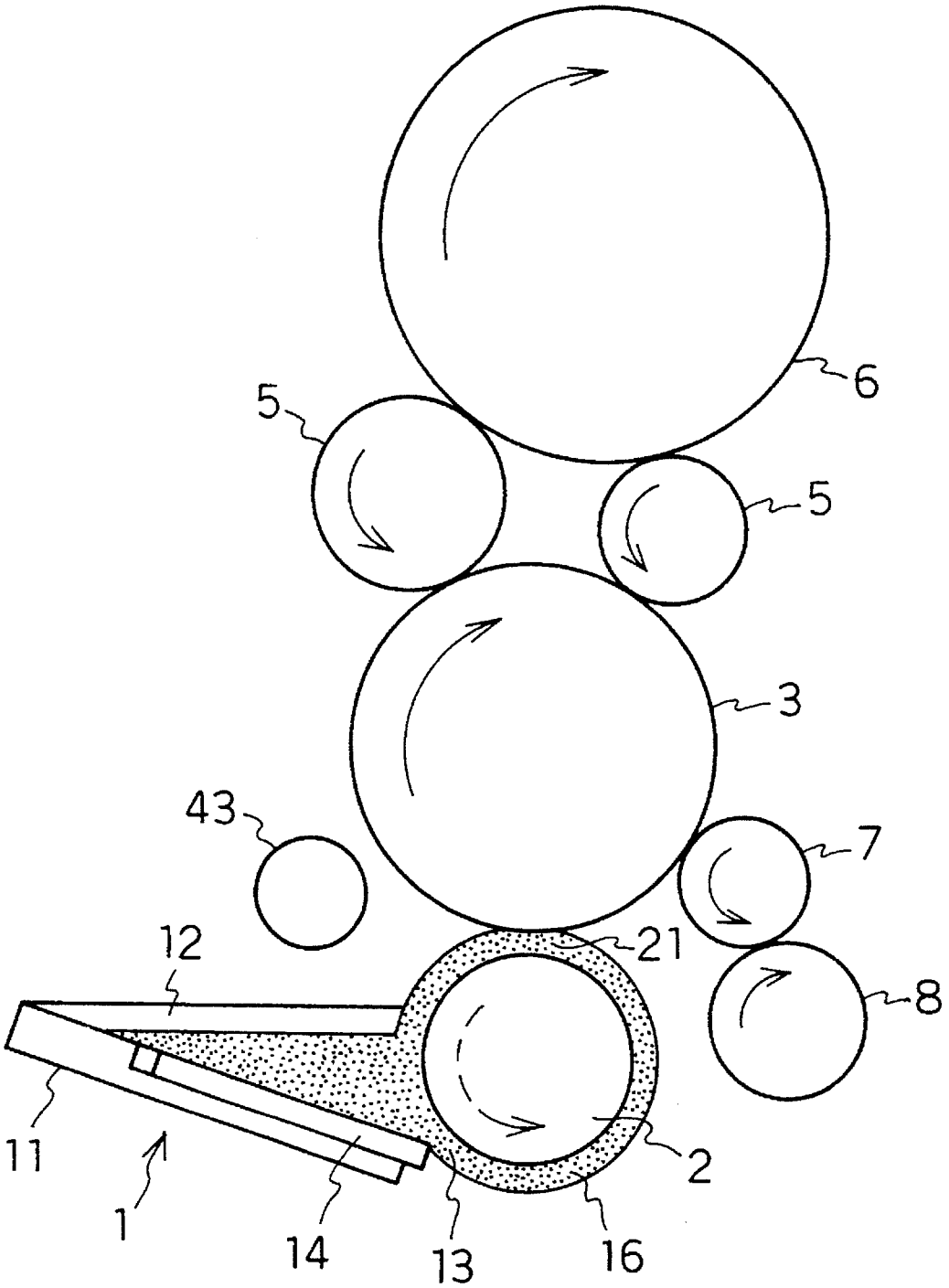
FIG. 14 is a sectional side elevation of another modification of the second embodiment of the ink furnishing apparatus in non-keyless ink furnishing mode.
Figure 15:
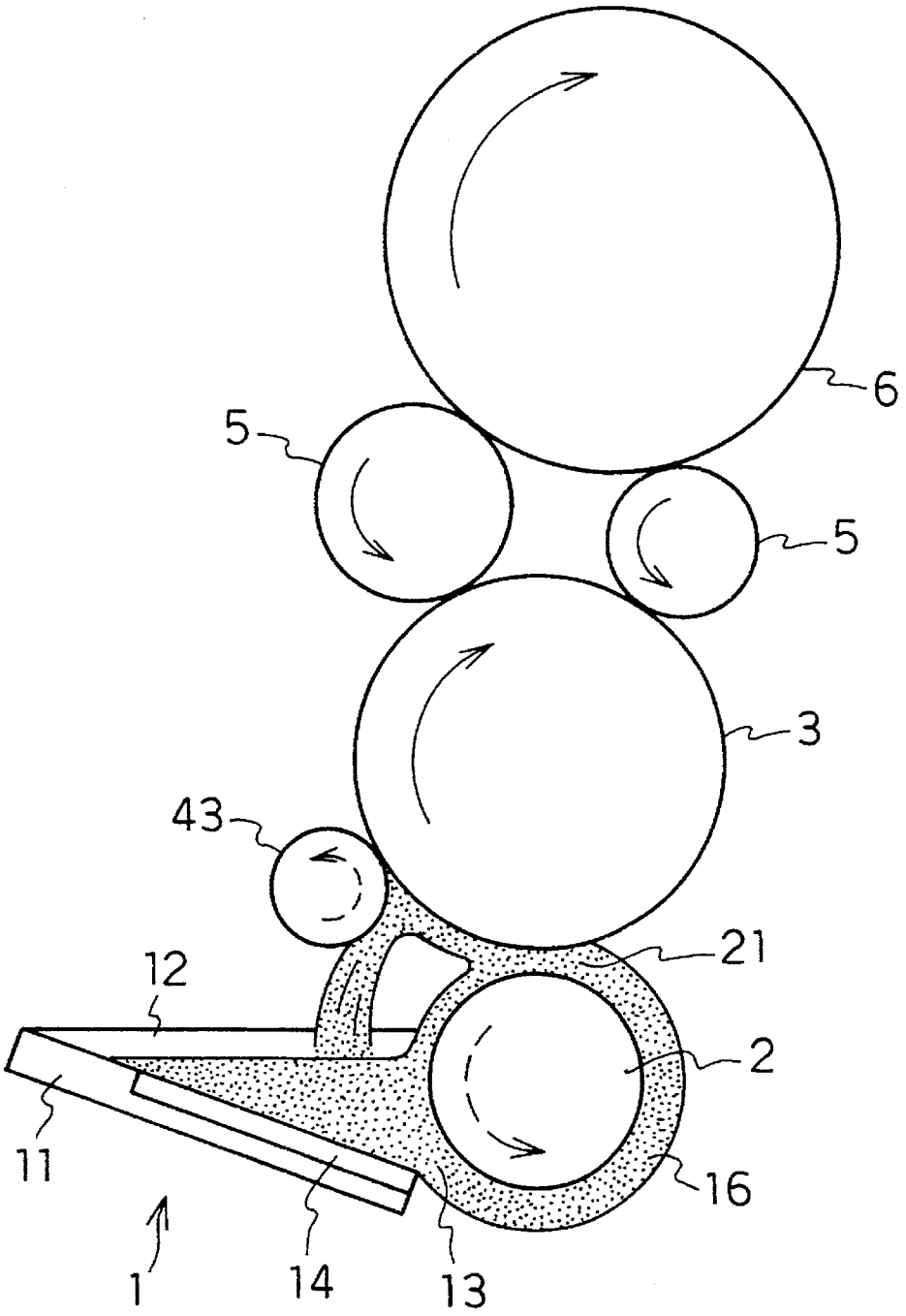
FIG. 15 is a sectional side elevation of the third embodiment of an ink furnishing apparatus according to the present invention, which is shown in the keyless ink furnishing mode.
Figure 16:
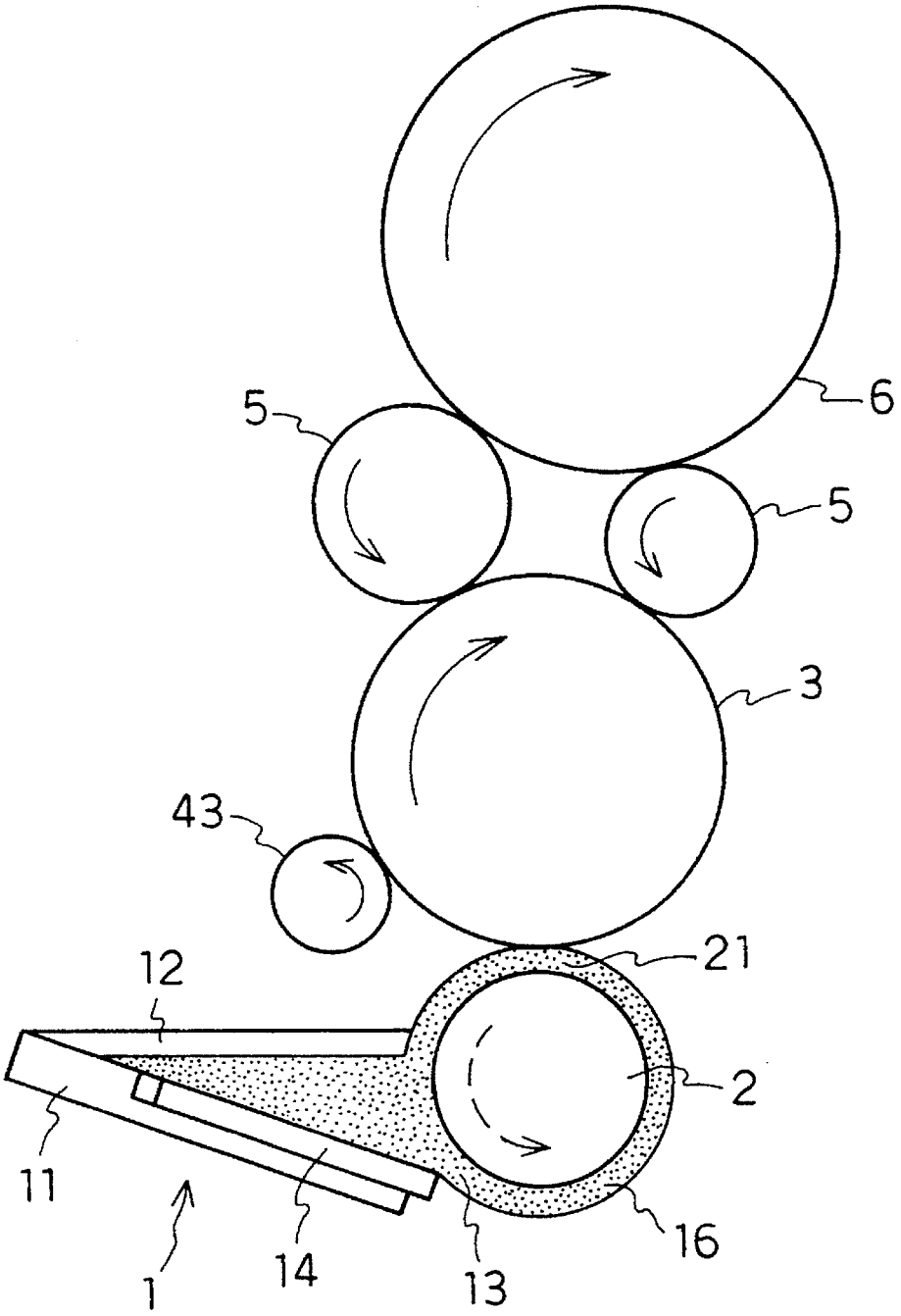
FIG. 16 is a sectional side elevation of the third embodiment of an ink furnishing apparatus according to the present invention, which is shown in the non-keyless ink furnishing mode.
Figure 17:
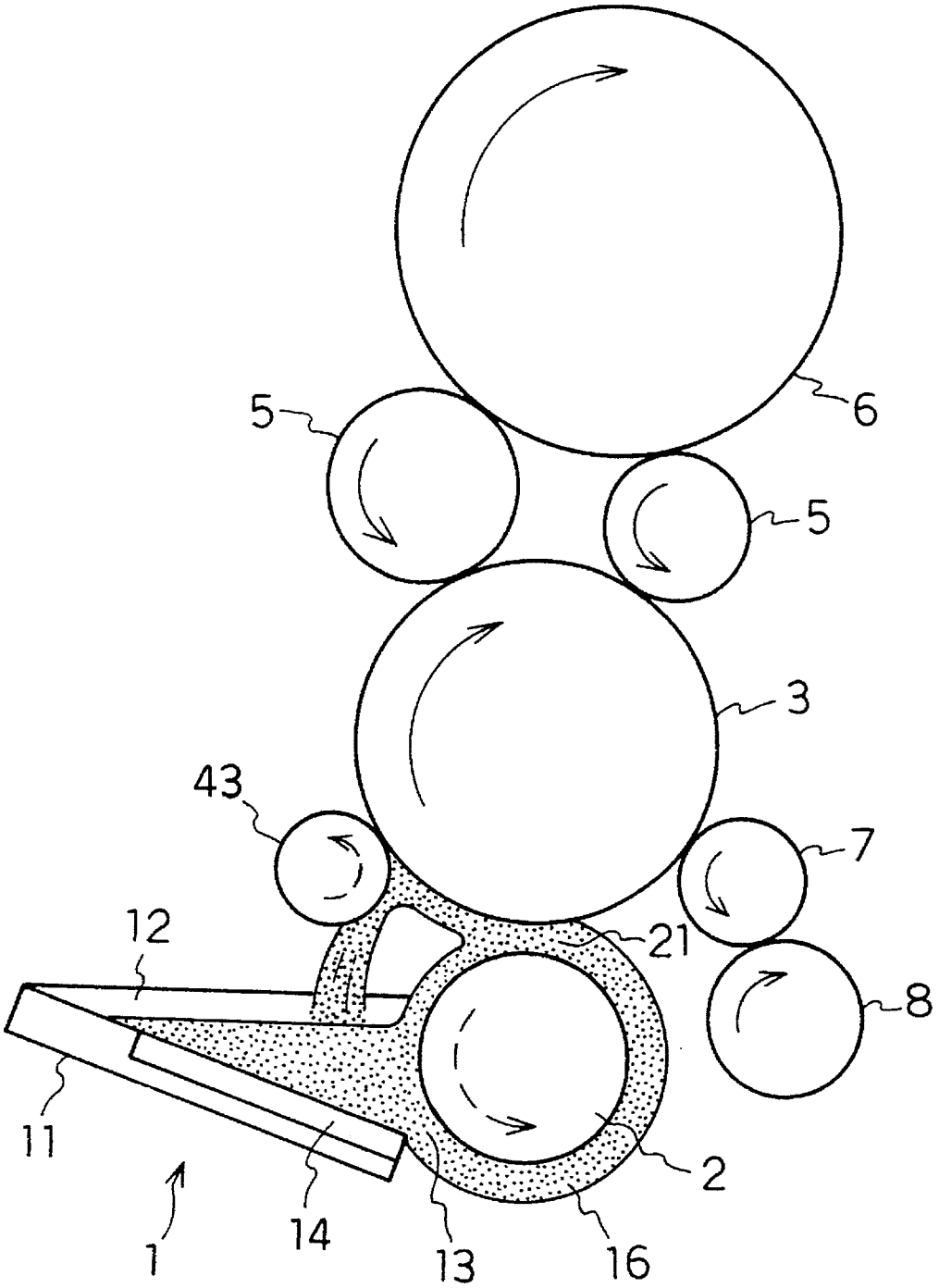
FIG. 17 is a sectional side elevation of the fourth embodiment of an ink furnishing apparatus according to the present invention, which is shown in the keyless ink furnishing mode.
Figure 18:
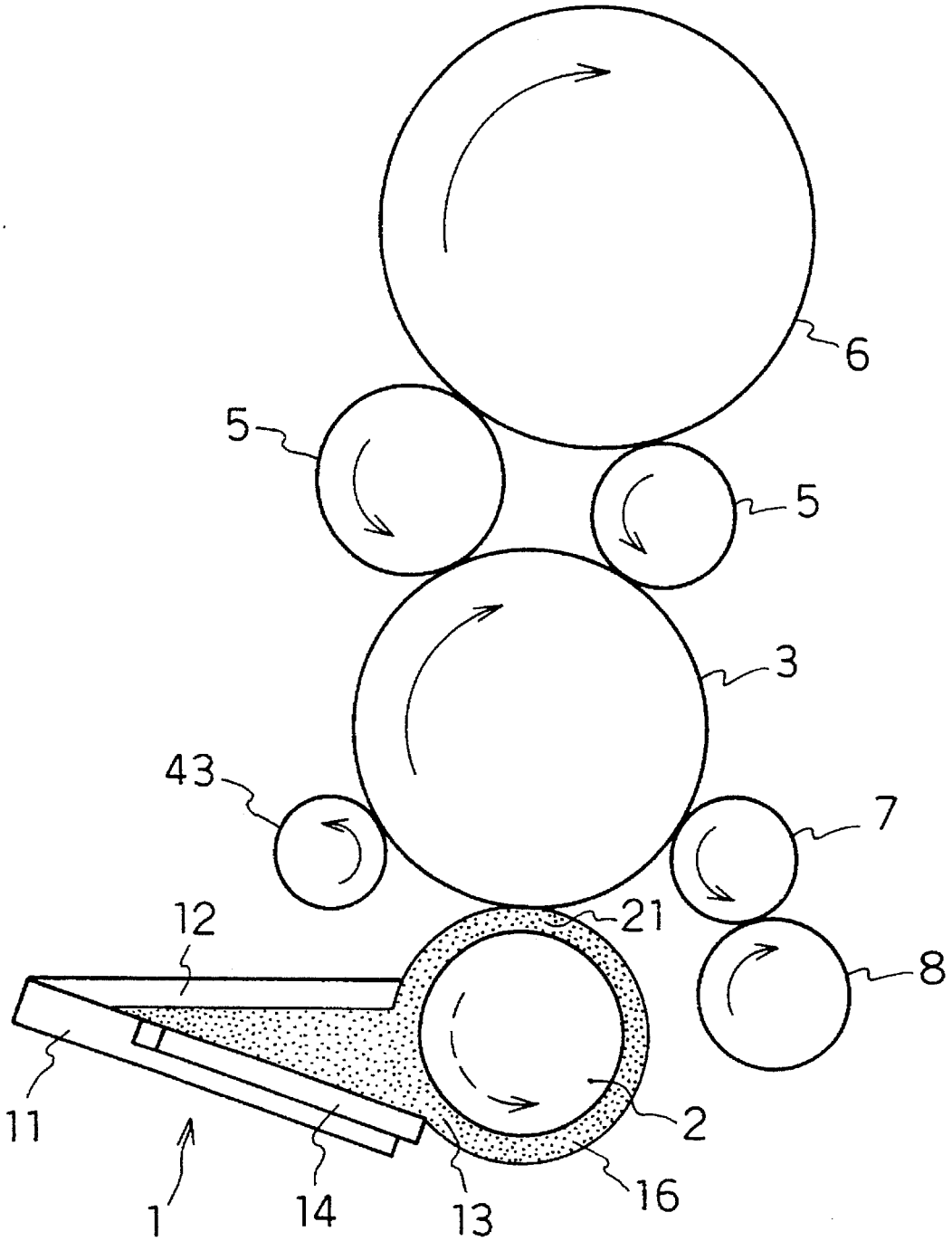
FIG. 18 is a sectional side elevation of the fourth embodiment of an ink furnishing apparatus according to the present invention, which is shown in the non-keyless ink furnishing mode.

At first, FIG. 1 is a perspective view showing general construction of the first embodiment of an ink furnishing apparatus according to the present invention, and FIG. 2 is a perspective view showing general construction of the second embodiment of an ink furnishing apparatus according to the invention. In FIGS. 1 and 2, an ink fountain 1 is defined by a base descending toward a peripheral surface of a fountain roller 2 and side plates 12, 12 at both ends of a groove defined by the base and the peripheral surface of the fountain roller 2. The upper portion of the ink fountain 1 is opened. An ink is stored in the groove. Between the lower end of the base 11 and the peripheral surface of the fountain plate 2, a first gap 13 (see FIGS. 3 to 19) is defined. Through the first gap 13, the ink deposited on the peripheral surface of the fountain roller is carried out of the ink fountain 1 according to rotation of the fountain roller.

Figure 19:
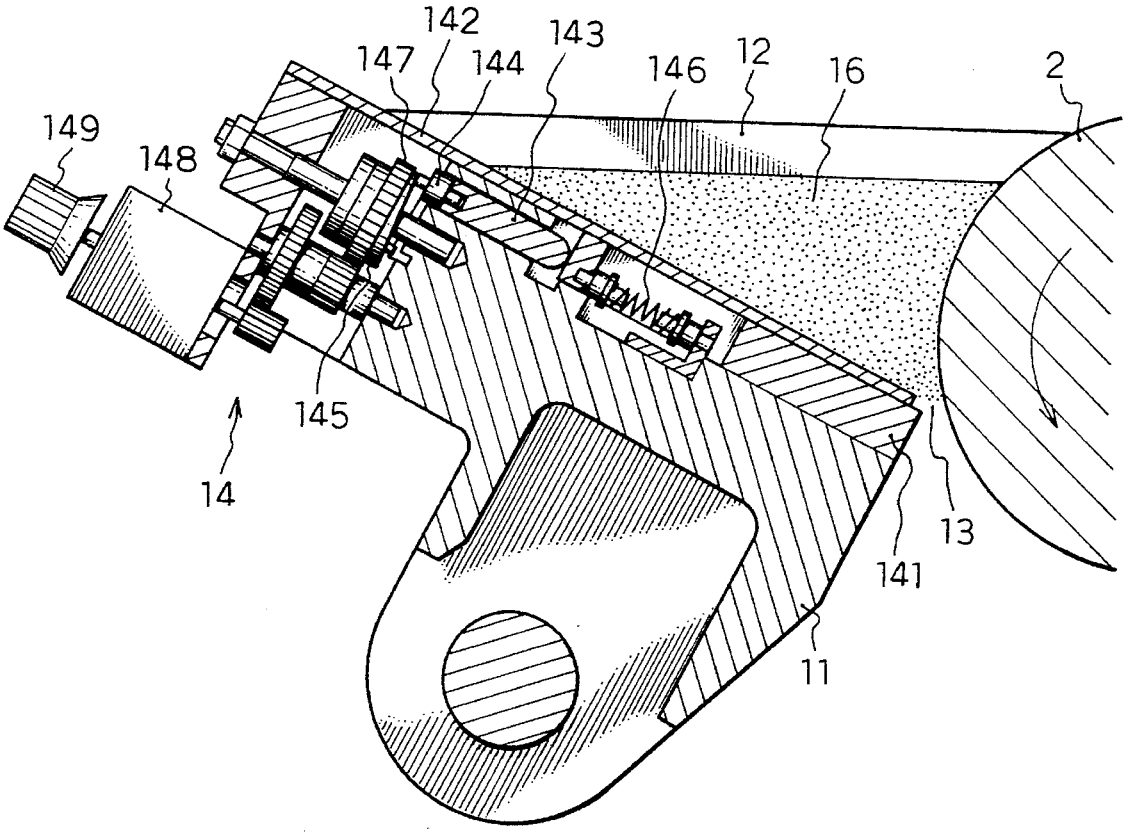
FIG. 19 is a longitudinal section showing one embodiment of a first gap adjusting means provided in an ink fountain in the ink furnishing apparatus according to the invention.

The first gap 13 can be adjusted to be narrower and wider per respective zones defined by dividing along the axial direction of the fountain roller per predetermined length, by means of a first gap adjusting means 14. One embodiment of the first gap adjusting means 14 is illustrated in FIG. 19. As shown, the first gap adjusting means 14 is constructed by securing a bottom plate 142 with a predetermined clearance to the tilted upper surface of the base 11, disposing a plurality of divided adjusting plates 141 having a thicknesses corresponding to the clearance in a condition where a plurality of divided adjusting plates 141 are mutually contacting to each other along the axial direction of the fountain roller 2, and providing shifting mechanism for each divided adjusting plate for shifting the latter toward and away from the peripheral surface of the fountain roller 2.

The shifting mechanism includes a compression spring 146 for biasing the divided adjusting plate 141 in a direction away from the peripheral surface of the fountain roller 2, a push rod 143 abutting to the rear end of the divided adjusting plate 141 and exerting a force against the spring force of the compression spring 146, an end cam 145 opposing to the read end of the push rod 143 and having a ring-shaped cam face, a cam follower 144 mounted on the read end of the push rod 143 and contacting with the cam face of the end cam 145, a driving source 148 for driving to rotate the end cam 145 and a transmission mechanism 147 constituted of a plurality of mutually meshed gears for transmitting the driving force of the driving source 148. It should be noted that the driving source 148 is provided with an operation knob 149 at one end of an output shaft thereof for permitting manual input of the driving force.

The opened front edge portion of the ink fountain 1 is blocked by the peripheral surface of the fountain roller 2 which is provided with defining the first gap 13 with the lower end of the tilted surface of the base 11.

The fountain roller 2 is driven to rotate in a direction that the peripheral surface of thereof blocking the opened front edge portion of the ink fountain moves downwardly. The peripheral speed in rotation of the fountain roller 2 is variable depending upon the peripheral speed of a printing plate but roller than the latter in the extent of 1/30 to 1/1000, for example.

At downstream of the fountain roller 2 in the ink furnishing, a metering roller 3 is provided. The peripheral surface of the metering roller 3 is opposed to the peripheral surface of the fountain roller 2 with defining a second gap 21 (see FIGS. 1 to 18) which is smaller than the first gap 13, therebetween.

Figure 20:
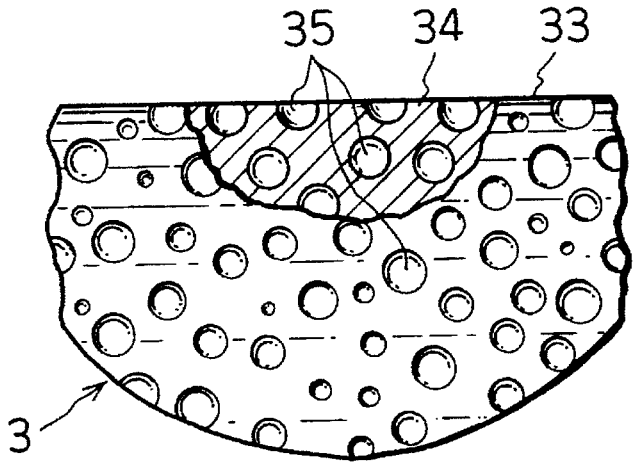
FIG. 20 is an enlarged illustration including a partial section of a part of the peripheral surface of one embodiment of a metering roller in the ink furnishing apparatus according to the invention.
Figure 21:
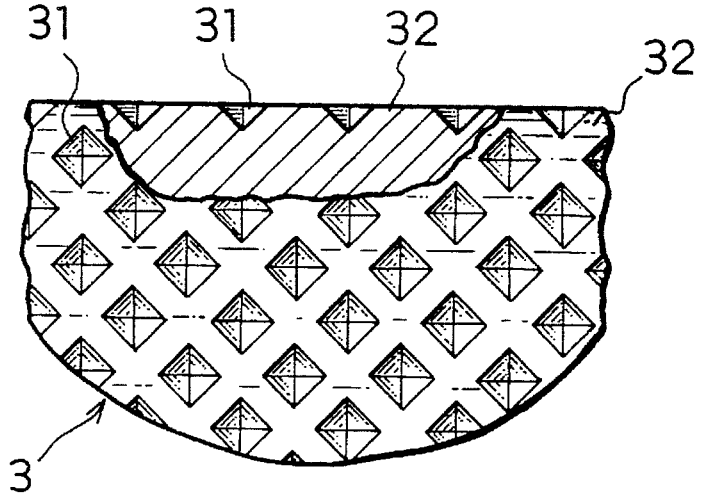
FIG. 21 is an enlarged illustration showing a partial section of a part of the peripheral surface showing another embodiment of the metering roller in the ink furnishing apparatus according to the invention.

As shown in FIG. 20, on the periphery of the metering roller 3, a large number of fine cavities, each of which can maintain a given amount of ink, are formed in uniform distribution. The fine cavities are defined by fine voids 35 uniformly distributed in a matrix 34 forming an outer peripheral layer 33 of the metering roller 3. Namely, in more concrete, the outer peripheral layer 33 of the metering roller 3 is formed by a material, in which fine hollow body called micro balloons of 5 to 300 μm in diameter are mixed with a synthetic resin matrix for uniform dispersion.

The metering roller 3 formed by uniformly dispersing the fine voids 35 in the matrix 34 forming the outer peripheral layer 33 will not cause significant or noticeable variation of the ink amount to be stored in the cavities on the peripheral surface of the metering roller 3 even when the peripheral surface of the metering roller 3 is worn by repeated ink scraping action of a doctor means 4 which will be discussed later, since the lost volume of the ink receptacle amount by wearing off of some fine voids 35 can be compensated by the voids newly exposed to the peripheral surface.

The metering roller 3 having the outer peripheral layer formed by dispersing the fine void in the synthetic resin matrix is formed to have a Shore hardness in a range of 70 to 100 (Shore A).

In the alternative, the metering roller 3 with a uniformly distributed fine cavities may also formed by a large number of regularly arranged recessed cells 31 and ridges 32 surrounding respective cells, Such recess cell may be formed by rolling, laser dulling or corrosion on the surface of a material, such as metal, synthetic resin, tangusten carbide and so forth, in a density of 80 lines/cm to 200 lines/cm.

A form roller 5 is provided in contact with the peripheral surface of the metering roller at downstream of the transfer position where the ink is transferred from the fountain roller 2 to the metering roller 3, and in contact with a printing plate on a plate cylinder 6. The form roller 5 rotates in such a direction that the shifting direction of the peripheral surface in rotation is the same as the shifting direction of the peripheral surface of the metering roller 3 at the contacting position therewith, and the shifting direction of the peripheral surface in rotation is the same as the shifting direction of the peripheral surface of the printing plate on the plate cylinder 6. The form roller 5 iS a roller having a rubber surface layer having a Shore hardness in a range of 20 to 40 (Shore A).

The metering roller 3 and the form roller 5 rotate at peripheral speeds substantially equal to the peripheral speed of the printing plate on the plate cylinder 6.

In the second embodiment as illustrated in FIG. 2, in addition to the construction set forth above, a rider roller 7 is provided at the downstream side of the contacting position between the metering roller 3 and the form roller 5 in the rotating direction of the metering roller and at the upstream side of the contacting position between the metering roller 3 and the fountain roller 1. The peripheral surface of the rider roller 7 is held in contact with the peripheral surface of the metering roller 3. Also, another rider roller 8 is provided with contacting the peripheral surface thereof onto the peripheral surface of the rider roller 7.

One of rider rollers 7 and 8 is a roller having rubber surface layers of a Shore hardness of 20 to 40 (Shore A) and the other is a roller having a metal or ceramic surface layer. When the metering roller 3 has the metal or tangusten carbide surface layer, the rider roller 7 becomes the roller with the rubber surface layer. On the other hand, when the metering roller 3 is the roller having synthetic resin or synthetic resin based surface layer of a Shore hardness of 70 to 100 (Shore A), the rider roller 7 may be either the roller with the rubber surface layer or the roller with the metal or ceramic surface layer, as appropriately selected.

The rider roller 8 may neglected. Also, a plurality of rider rollers 7 may be provided. When a plurality of rider rollers 7 are provided, the rider rollers 8 may be provided corresponding to all of the rider rollers 7 or corresponding to selected one or more of rider rollers 7. In the further alternative, it is possible to not provide the rider roller 8 for any of the rider rollers 7.

The rider roller 7 rotates in such a direction that the peripheral surface thereof moves in the same direction to the peripheral surface of the metering roller 3 at the contacting position therebetween. On the other hand, the rider roller 8 rotates in such a direction that the peripheral surface thereof moves in the same direction to the peripheral surface of the rider roller 7 at the contacting position therebetween. The peripheral speeds of the rider rollers 7 and 8 are substantially equal to the peripheral speed of the metering roller 3.

The rider rollers 7 and 8 depress the ink passing across the contacting position therebetween to cause disruption of the ink to increase flow ability of the ink. By repeating this action during printing operation, the flow ability of the overall ink in the ink furnishing apparatus can be gradually increased to smoothness of ink furnishing. Also, in case of the lithographic printing utilizing dampening water, the problem caused by the dampening water can be eliminated.

The doctor means 4 is located at the downstream side of the contacting position between the metering roller 3 and the fountain roller 2 and at the upstream side of the contacting position between the metering roller 3 and the form roller 5 in the direction of rotation of the metering roller 3, in contact with the peripheral surface of the metering roller 3. The concrete construction of the doctor means 4 is illustrated in FIGS. 3 to 14, in which FIGS. 3 to 6 show a doctor blade 41 as the doctor means, FIGS. 7 to 10 show a doctor bar 42, and FIGS. 11 to 14 show doctor roller 43. In either case, the doctor means 4, i.e. the doctor blade 41, the doctor bar 42 or doctor roller 43, is movable between an excessive ink scraping position placed in contact with the peripheral surface of the metering roller 3 in its overall length for scraping off the excessive ink from the peripheral surface of the metering roller and a released position placed away from the metering roller 3 not to act on the ink carried on the metering roller 3.

As shown in FIGS. 3 to 6, when the doctor means 4 is the doctor blade 41, a doctor holder 412 carrying a blade 411 is integrally mounted on a holder displacing shaft 413 which is provided on a frame in a condition where angular displacement is permitted. An actuation arm 414 is connected to at least one side of the holder displacing shaft 413. The free end of the actuation arm 414 iS connected to an output rod of a hydraulic cylinder as driving source for shifting the blade 411 toward and away from the peripheral surface of the metering roller 3. The hydraulic cylinder 415 is pivotably mounted on a not shown frame by a hydraulic cylinder support shaft 416. Thus, a rotary displacing mechanism for shifting the blade 411 toward and away from the peripheral surface of the metering roller 3 can be constructed.

Next, as shown in FIGS. 7 to 10, when the doctor means 4 is the doctor bar 42, a stay end shafts 423 are provided at both ends of a back-up stay 422 which carries a bar 421. The back-up stay 422 is thus pivotably supported on the not shown frame. While it is not illustrated, similar rotary displacing mechanism to the case of the doctor blade is associated with at least one side of the stay end shaft 423. Thus, by means of the rotary displacing mechanism, the bar 421 can be shifted toward and away from the peripheral surface of the metering roller 3.

When the doctor means 4 is a doctor roller 43 as shown in FIGS. 11 to 14, the both ends of the doctor roller 43 are supported by eccentric sleeves 431 (only one is shown) to form a mechanism for shifting the doctor roller 43 toward and away from the metering roller 3, as shown in 22. Namely, by causing angular displacement of the eccentric sleeve 431 relative to a frame 9 by any appropriate means, the doctor roller 43 is shifted between a contacting position (FIGS. 11 and 13) contacting with the peripheral surface of the metering roller 3 and a released position (FIGS. 12 and 14) placed away from the peripheral wall of the metering roller 3.

In the alternative embodiment, as shown in FIGS. 15 to 18, the doctor roller 43 may be constantly placed in contact with the peripheral surface of the metering roller 3 during printing operation. In such case, doctor roller 43 is selectively driven in a rotation for scraping off the ink and in a rotation for not scraping the ink.

At first, rotation of the doctor roller 43 for scraping off the ink from the metering roller 3 is a rotation to cause a sufficiently large relative peripheral speed difference between the doctor roller 43 and the metering roller 3. The large relative peripheral speed difference can be created by driving the doctor roller 43 to rotate at the lower peripheral speed than the peripheral speed of the metering roller 3, or by driving the doctor roller 43 in a direction to cause the peripheral surface thereof to move in the opposite direction to the peripheral surface of the metering roller 3 at the contacting position. On the other hand, the rotation of the doctor roller 43 for not scraping off the ink from the metering roller 3 is a rotation to cause no or sufficiently small relative peripheral speed difference between the doctor roller 43 and the metering roller 3. This can be achieved at driving the doctor roller 43 in a direction for shifting the peripheral surface thereof in the same direction to the shifting direction of the peripheral surface of the metering roller 3 at the contacting point and at a speed substantially equal to the peripheral speed of the metering roller.

Figure 22:
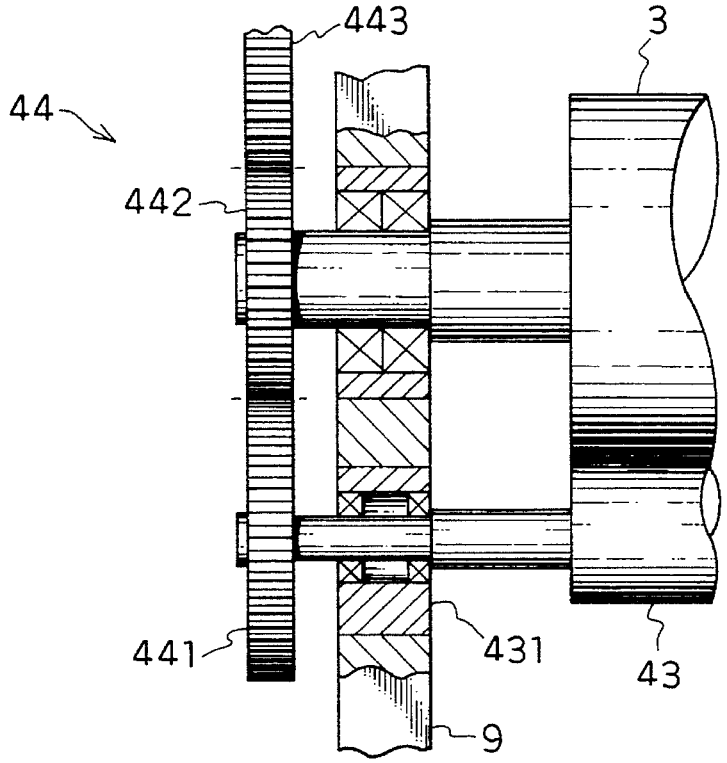
FIG. 22 is a partially sectioned enlarged illustration of a major part of one example of a drive mechanism of a doctor roller in the fourth embodiment, and contacting and releasing mechanism of the doctor roller relative to the metering roller.
Figure 26:
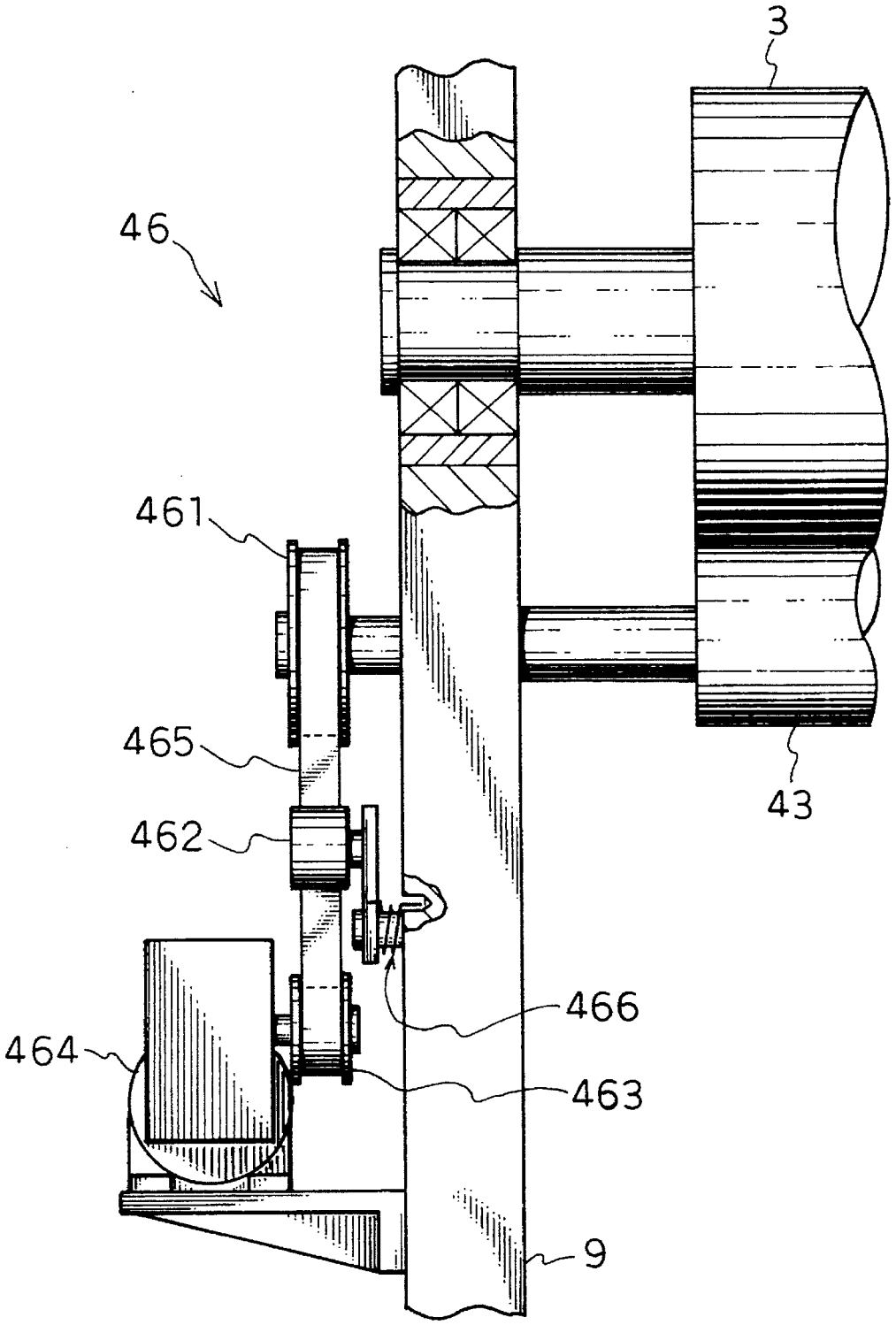
FIG. 26 is a partially sectioned enlarged illustration of one embodiment of a drive mechanism variable of driving direction between forward direction and reverse direction and variable of rotation speed of the doctor roller relative to the metering roller, in the mode where the doctor roller is in contact with the metering roller.

According to the present invention, the doctor roller 43 is designed to have one of various drive mechanisms set out below for adapting to various printing modes. Namely, as shown in FIGS. 22 and 26, the doctor roller 43 may be driven by a drive mechanism which can drive the doctor roller 43 at a speed where the peripheral speed thereof is lower than the peripheral speed of the metering roller 3, and at this time, the driving direction of the doctor roller is the direction for shifting the peripheral surface thereof in the same direction to the shifting direction of the peripheral surface of the metering roller 3 at the contacting point. In the alternative, as shown in FIGS. 24 and 26, the doctor roller may be driven by a drive mechanism which drives the doctor roller 43 in a direction to cause the peripheral surface thereof to move in the opposite direction to the peripheral surface of the metering roller 3 at the contacting position irrespective of the peripheral speed.

The drive mechanism 44 shown in FIG. 22 is constructed to transmit a rotation of a transmission gear 443 located at the upstream side in the drive train to a gear 441 at the side of the doctor roller, which gear 441 is mounted on the axial end of the doctor roller 43, via a gear 442 at the side of the metering roller, which gear 442 is mounted on the axial end of the metering roller 3. Thus, the doctor roller 43 is be driven at a speed where the peripheral speed thereof is lower than the peripheral speed of the metering roller 3, and at this time, the driving direction of the doctor roller is the direction for shifting the peripheral surface thereof in the same direction to the shifting direction of the peripheral surface of the metering roller 3 at the contacting point.

Figure 24:
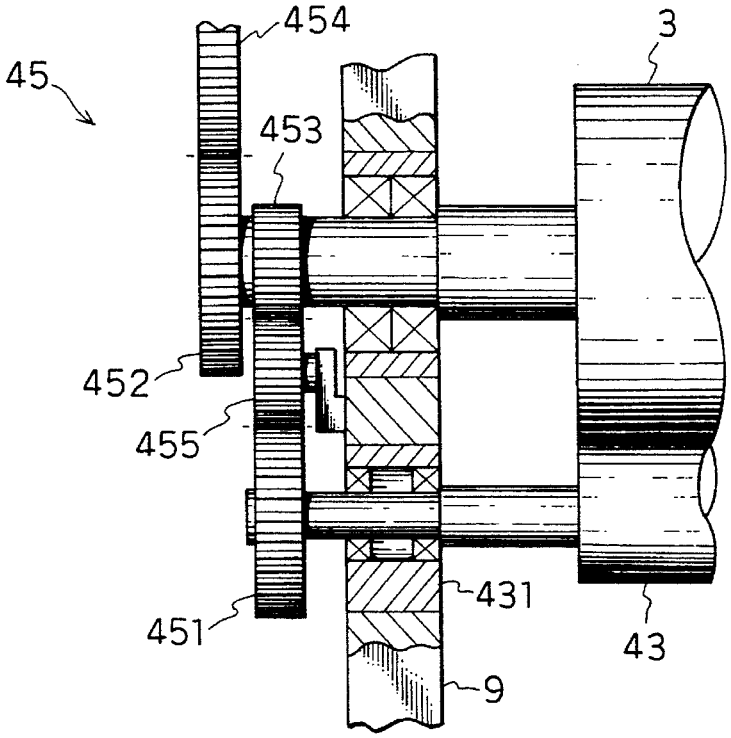
FIG. 24 is a partially sectioned enlarged illustration of an embodiment of a drive mechanism, in which the direction of rotation of the doctor roller becomes opposite to the direction of rotation of the metering roller in the mode where the doctor roller is in contact with the metering roller.

On the other hand, a drive mechanism of FIG. 24 is constructed to transmit rotation of a transmission gear 454 positioned at the upstream side of the power train to the gear 451 at the doctor roller side mounted on the axial end of the doctor roller 43 via a first gear 452 at the metering roller side mounted on the axial end of the metering roller, a second gear 453 at the metering roller side integral with the first gear 452 and an intermediate gear 455 rotatably supported on the frame 9 by an appropriate support means. Thus, the doctor roller is driven in a direction to cause the peripheral surface thereof to move in the opposite direction to the peripheral surface of the metering roller 3 at the contacting position irrespective of the peripheral speed.

A drive mechanism 46 shown in FIG. 26 has an independent doctor roller driving source 464 at the upstream side of the drive train. The rotation of the driving source 464 is transmitted to the doctor roller 43 via a transmission belt 465 warped around a pulley 463 at the driving source side and a pulley 461 at the doctor roller side mounted at the axial end of the doctor roller.

In the driving source 46, the rotating direction of the doctor roller 43 can be selected by selecting driving direction of the driving source 464 in forward or reverse directions. Also, the peripheral speed of the doctor roller 43 may be controlled by controlling number of rotation of the output shaft of the driving source 464 per unit time. Variation of the peripheral speed of the doctor roller 43 enables variation of the thickness of the ink layer to pass the contacting portion between the metering roller 3 and the doctor roller 43 utilizing elastic hydro lubrication phenomenon. By this, it becomes possible to vary the printing density of the entire printing surface. Also, it is possible to selectively drive the doctor roller in a rotation for scraping off the ink and in a rotation for not scraping the ink. It is desirable to select the material and the hardness of the doctor roller depending upon the material and hardness of the peripheral surface of the metering roller 3.

Also, in case of the driven mechanism 46 of FIG. 26, it is preferred to employ a cogged belt as the transmission belt 465 and teethed pulleys as the driving source side pulley 463 and doctor roller side pulley 461 so that the cogged belt may engage with the teethed pulleys 463 and 461 for assuring power transmission. Also, it is desirable to provide a tension pulley 462 for removing play of the belt. In further preferred construction, the tension pulley 462 is biased toward the mating surface of the transmission belt 465 for automatically adjusting the tension of the belt depending upon the magnitude of the play of the belt.

As set forth, the material and hardness of the surface layer of the doctor roller 43 is selected depending upon the material and hardness of the surface layer of the metering roller 3. Normally, when the hardness of the surface layer of the metering roller 3 is high, the material and the hardness of the doctor roller 43 is selected o have low hardness. On the other hand, when the hardness of the surface layer of the metering roller 3 is low, the material and the hardness of the doctor roller 43 is selected o have high hardness.

Figure 23:
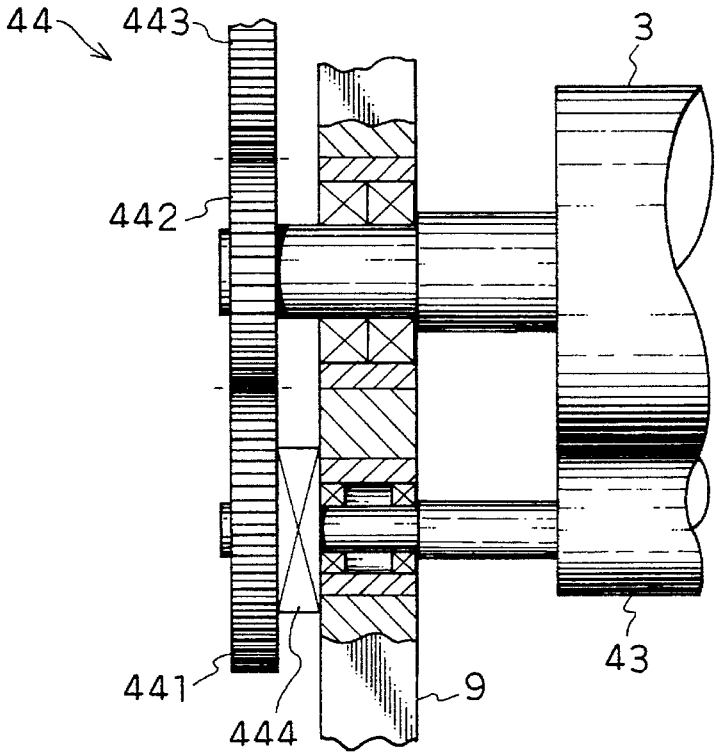
FIG. 23 is a partically sectioned enlarged illustration of the major part showing one embodiment of connecting and disconnecting power transmission to the doctor roller in the mode contacting the doctor roller to the metering roller, wherein, in the disconnecting state, the doctor roller is driven by rotation of the metering roller.
Figure 25:
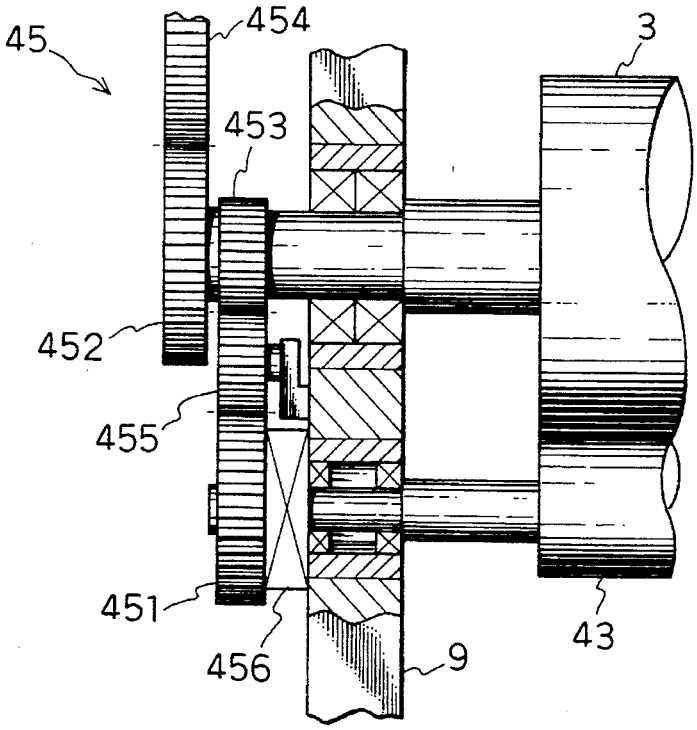
FIG. 25 is a partically sectioned enlarged illustration of the major part showing one embodiment of connecting and disconnecting power transmission to the doctor roller in the mode contacting the doctor roller to the metering roller, wherein, in the disconnecting state, the doctor roller is driven by rotation of the metering roller.

As shown in FIGS. 15 to 18, the peripheral surface of the doctor roller 43 is provided so that printing operation can be performed only when it is in contact with the peripheral surface of the metering roller 3. Then, as shown in FIGS. 23 and 25, the mechanism for selectively varying rotation of the doctor roller 43 is constructed by providing an electromagnetic clutches 444 and 456 between the gears 441, 451 at the doctor roller side and the doctor roller 43. By the electromagnetic clutches 444 and 456, the rotation transmitted to the gears 441 and 451 is switched between a position not to driving the doctor roller 43 and a position to drive the doctor roller 43.

At the condition where the doctor roller 43 is completely disconnected from the drive mechanism 44 and 45, the doctor roller 43 is driven by the metering roller 3 for friction at the contacting position.

On the other hand, even with the drive mechanism 46 of FIG. 26, rotation of the doctor roller 43 can be selectively controlled. Namely, the number of rotation of the driving source 464 and the rotating direction are varied between a setting to rotate the doctor roller in a rotation not scraping off the ink from the metering roller 3, where the doctor roller 43 is driven to have substantially equal peripheral speed to the metering roller in a direction to cause shifting of the peripheral surface to move in the same direction to the peripheral surface of the metering roller 3, a setting where the doctor roller 43 is driven to have the peripheral speed lower than peripheral speed to the metering roller in a direction to cause shifting of the peripheral surface to move in the same direction to the peripheral surface of the metering roller 3 by lowering the rotation speed of the driving source 464 per unit time with maintaining the driving direction in the former case, and a setting where the rotation at the arbitrary number of the rotation per unit of the driving source 464 is directed in the opposite direction to the former two settings to scrape off the ink from the peripheral surface of the metering roller 3.

It should be noted that, in the driving mechanism 46 of FIG. 26, the electromagnetic clutch (not shown) is provided between the pulley 461 at the doctor roller side and the doctor roller 43 for operation substantially the same those in the mechanism of FIGS. 23 and 25 as set forth above.

When printing for obtaining normal printing quality with the normal three primary color inks (yellow, cyan and magenta) and the black ink, namely printing is performed by the keyless printing, the first gap 13 between the base 11 of the ink fountain 1 or the divided adjusting plate 141 so as to make the first gap 13 maximum. Thus, the doctor means 4 is brought into contact with the peripheral surface of the metering roller 3. When the doctor means 4 is the doctor roller 43, the rotation of the doctor roller 43 is selected so as to make the relative peripheral speed between the doctor roller 43 and the metering roller 3 zero or sufficiently small not to scrape off the ink from the peripheral surface of the metering roller 3 for performing printing operation.

On the other hand, when printing is performed with a high viscous ink called special color ink other than the normal three primary color and black inks or with three primary color and black inks of higher viscosity, or when the printing image is present only in a partial region in the axial direction of the printing plate 6, printing with the non-keyless ink furnishing is performed. Namely, by means of the first gap adjusting means 14 the positions of the divided adjusting plates 141 are adjusted toward and way from the peripheral surface of the fountain roller 2. Then, the sizes of the first gap 13 defined between the tip ends of the divided adjusting plates 141 and the peripheral surface of the fountain roller 2 are adjusted adapting to the distribution of the image of the printing plate on the plate cylinder 6 in respective of divided zones divided in the axial direction of the plate cylinder 6 so that desired amount of ink can be drawn therethrough. On the other hand, the doctor means 4 is moved away from the peripheral surface of the metering roller 3, or when the doctor means 4 cannot be moved away from the peripheral surface of the metering roller 3, the rotation of the doctor roller 43 is selected so as not to scrape off the ink from the peripheral surface of the metering roller 3, to perform printing operation.

As set forth above, when the printing with the keyless ink furnishing and the printing with the non-keyless ink furnishing are performed by lithographic printing employing the dampening water, penetration of the dampening water into the ink furnishing apparatus can be removed. Therefore, drawbacks to be caused in ink furnishing by penetration of the dampening water can be avoided.

Figure 27:
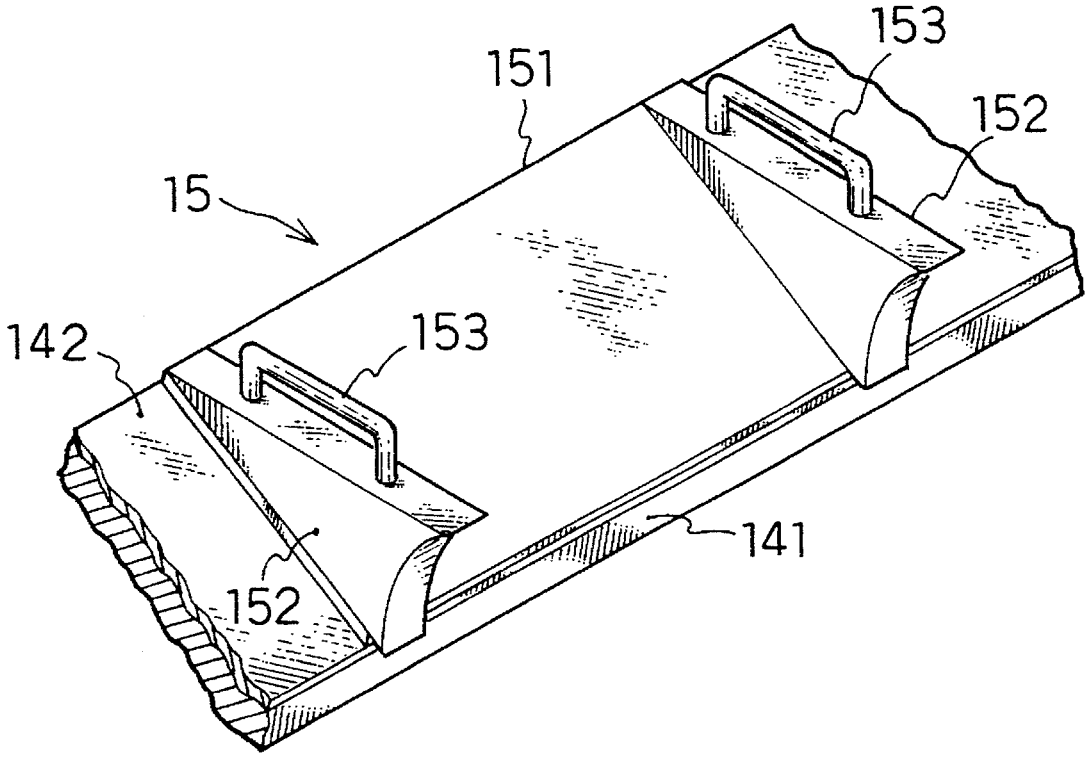
FIG. 27 is a perspective view showing one example of partitioning means for devising the ink fountain for use a part thereof in the ink furnishing apparatus according to the invention.

When the printing image is printed with a printing plate only present in a partial region in the axial direction of the plate cylinder 6, the printing is performed with non-keyless ink furnishing. Then, at this time, as shown in FIG. 27, at a portion aligning with the region of the printing image of the printing plate of the ink fountain 1 is provided with an ink fountain partitioning means 15. Then, when printing operation is performed by storing the ink in the ink fountain partitioning means 15. Then, in the ink furnishing, the region of deposition of the ink is limited to make wasting of the ink smaller. In this case, cleaning of the ink fountain 1 and so forth after printing can be effected only limited region to shorten the period required for cleaning and to make it easier.

The ink fountain partitioning means 15 comprises a partitioning bottom plate 151, partitioning side plates 152 and a handle 153 to facilitate handling of the ink fountain partitioning means 15. At the front sides, the partitioning side plates 152 are formed with unevenness complementary with the peripheral surface of the fountain roller 2 so that the partitioning side plates 152 tightly contact with the peripheral surface of rotating fountain roller 2. The uneven surface of the side plates 152 is formed with a material having low hardness, such as a synthetic resin or lead or so forth, so as not to damage the peripheral surface of the fountain roller 2. On the other hand, the partitioning bottom plate 151 is set so as not to narrow the maximum open area of the first gap 13 between the divided adjusting plate 141 and the fountain roller 2 when the ink fountain partitioning means 15 is tightly fitted on the ink fountain 1. The distance between the opposing side walls 152 is selected to be 2 pages to ¼ pages of the newspaper in the case of the ink fountain of the printing press which can print four pages of the newspaper, which is slightly wider than the region of the printing image on the printing plate.

By the printing operation set forth above, the region of depositing the ink by ink furnishing can be limited to the narrow portion to reduce wasted ink amount. Also, cleaning of the ink fountain 1 after printing operation can be limited to small area to make a period required for cleaning shorter and to facilitate cleaning.

It should be noted that, in the keyless furnishing, upon scraping off the ink from the metering roller 3 by means of the doctor means 4, the frictional force between the doctor means 4 and the metering roller 3 can be varied significantly depending upon presence or absence of the ink to cause uneven wearing on the metering roller 3. Therefore, it is not possible to ink furnishing employing the ink fountain partitioning means 15.

The ink furnishing apparatus according to the present invention is successful to certainly and smoothly furnish the high viscous ink to the plate surface of the plate cylinder by providing a mechanism to promote a phenomenon to temporarily softening of the high viscous ink, namely the phenomenon to temporarily increase flow ability of the high viscous ink. That is, according to the shown construction of the present invention, the high viscous ink is drawn through the first gap defined between the front edge of the base of the ink fountain and the fountain roller, carried on the peripheral surface of the fountain roller downwardly. Then, the high viscous ink is extended to be the thickness corresponding to the width of the first gap. By extension upon drawn out from the ink fountain, an external force is exerted on the high viscous ink to cause first stage softening. Also, upon transferring of the ink from the peripheral surface to the metering roller through the second gap which is smaller than the first gap, the peripheral speed of the metering roller is set at higher than the peripheral speed of the fountain roller to forcedly compress the ink to cause disruption to further promote temporary softening of the ink. Thus, the ink is easily deposited in the cavity or recess on the metering roller. Furthermore, when the rider rollers are provided, the high viscous ink is further compressed by repeated application of the external compression force to further and sufficiently increase the flow ability. Thus, the high viscous ink having high viscosity in the level not possible to use in conventional printing can be certainly, smoothly and continuously furnished to the printing plate of the plate cylinder.

Also, the invention which makes furnishing of the high viscous ink to the printing plate easier, makes it possible to satisfactorily adapt to multi-functioning of the printing mode. Namely, the present invention has the keyless ink furnishing function as a facility corresponding to normal quality printing and the non-keyless ink furnishing function to be a facility corresponding to special ink or high quality printing with further higher viscosity ink and spot printing, to make it possible to provide multi-function type printing press. Namely, by this invention, in the printing press utilizing the relatively high viscous ink, it becomes possible to select the keyless ink furnishing furnishing ink uniformly over entire surface of the printing plate in substantially uniform amount irrespective of distribution of the image to be printed, and the non-keyless ink furnishing furnishing desired amount of ink corresponding to the size of the image to be printed by ink amount is adjusted per divided zone along the axis of the plate cylinder adapting to the distribution of the image to be printed, depending upon the kind of ink to be used, required printing quality, distribution of the image for printing. Accordingly, with maintaining advantages of keyless ink furnishing, such as non-skill printing ability and so forth, the present invention can widen application of the same printing press with non-keyless ink furnishing. Thus, waste in investment can be reduced and necessity of extra facility which was inherent in the prior art, can be eliminated.

At first, as a facility corresponding to normal quality printing under demand for overall surface uniform printing mode by the keyless ink furnishing, with respect to the first gap adjusting means provided in the ink fountain, the ink furnishing apparatus is used in fully open position. In conjunction therewith, by switching operation of the doctor means including the doctor blade, doctor bar and doctor roller to shift between contacting position or provide ink scraping rotation for the doctor roller by providing sufficiently large relative peripheral speeds between the metering roller and the doctor roller, non-skill ink furnishing can be realized.

Furthermore, upon spot printing frequency required in color printing utilizing relatively high viscous ink and when the image occupying only a part in the axial direction of the plate cylinder is to be printed, the ink is furnished locally for only part corresponding to the image by non-keyless ink furnishing. Thus, it becomes possible to reduce wasted ink amount which is otherwise cause in keyless ink furnishing. Namely, in this case, the first gap adjusting means provided in the ink fountain is actuated to narrow respective of the divided first gaps to be necessary sizes independently of the other. In conjunction therewith, by the switching operation of the doctor means including the doctor blade, the doctor bar and the doctor roller, releasing or making the relative peripheral speeds between the doctor roller and the metering roller smaller or zero, color spot printing can be realized. Furthermore, upon spot printing, the ink fountain partitioning means which cannot be used in keyless ink furnishing is used to store the ink in the narrower range to locally furnish ink. Thus, in comparison with the keyless ink furnishing, in which the ink is stored in the overall ink fountain to perform ink furnishing, the amount of ink to be deposited on the periphery of the ink fountain to reduce wasted amount of the ink correspondingly. Furthermore, upon cleaning of the ink fountain after printing, only limited area should be cleaned to reduce the load on the worker.

Also, according to the present invention, by depression of the rider roller, the dampening water penetrating into the ink furnishing apparatus is mixed in the ink and dispersed to remove by evaporation. Therefore, striping of the roller upon ink furnishing due to the penetrated dampening water, as can be caused in the conventional keyless ink furnishing utilizing relatively high viscous ink, is successfully avoided. Therefore, even when penetration of the dampening water is caused, smooth and continuous ink furnishing can be made possible.

In addition, according to the present invention, in the opposing portions of both peripheral surfaces, the fountain roller and the downstream side roller rotate to cause displacement of both peripheral surface in the same direction, splashing of the ink which can be caused in the keyless ink furnishing apparatus for relatively high viscous ink, will never be caused. This, ink furnishing efficiency can be improved without causing stain of the environment.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An ink furnishing apparatus for a printing press for performing printing by furnishing an ink to a printing plate on a plate cylinder, comprising:

a form roller rotating in contact with a peripheral surface of the printing plate;

a rotatable metering roller having a peripheral surface contacting the upstream side of the peripheral surface of said form roller in the ink furnishing, and having a uniformly distributed plurality of fine recesses on a peripheral surface thereof for receiving the ink;

doctor means for removing an extra mount of ink from the peripheral surface of said metering roller at a position upstream of the contacting position of said form roller, said doctor means having switching means for switching the position between a contacting position where said doctor means is in contact with said metering roller for effecting removal of the extra amount of the ink and a released position where said doctor means is shifted away from the metering roller;

an ink fountain opposing to the upper portion of said doctor means and opened at the front side and the upper side, and constituted of both side plates and tilted base;

a fountain roller having a peripheral surface located at a position for blocking the opened front side of said ink fountain, and positioned adjacent to a front edge of said ink fountain via a first gap, and positioned adjacent to the peripheral surface of said metering roller at an upstream position from the contacting position of said doctor means via a second gap which is smaller than said first gap, and the peripheral surface of said fountain roller blocking the front side of said ink fountain and rotatable downwardly at a peripheral speed lower than the peripheral speed of said metering roller; and first gap adjusting means separately provided in said ink fountain for respective adjustment of divided zones defined along an axial direction of said fountain roller for adjusting said first gap, said apparatus having means selectively operable in:

an entire surface ink furnishing mode, in which said first gap is held fully opened, said doctor means is placed in contact with said metering roller, ink drawn through said fully opened first gap in a thickness corresponding to said first gap by rotation of said fountain roller, is furnished in an excess amount of ink onto the peripheral surface of said metering roller, with compression by passing through the second gap, the extra amount of ink on the peripheral surface is scraped off by means of said doctor means contacting with the peripheral surface of said metering roller to return to said ink fountain, and the ink is furnished onto a printing plate on the plate cylinder via the peripheral surface of said form roller in substantially uniform amount over the entire position along the axis of said metering roller, and a local ink furnishing mode, in which said first gap is adjusted to be narrower with respect to the divided zones by the adjusting means, said doctor means is released away from the peripheral surface of said metering roller, the ink drawn from said ink fountain by rotation of said fountain roller per each divided zone in the desired thickness is furnished on the peripheral surface of said metering roller in the amount corresponding to the thickness of the ink at each zone passed through said second gap, and the ink furnished on the peripheral surface of said metering roller is transferred to the printing plate on said plate cylinder via the peripheral surface of said form roller.

2. An ink furnishing apparatus for a printing press for performing printing by furnishing an ink to a printing plate on a plate cylinder, comprising:

a form roller rotating in contact with a peripheral surface of the printing plate;

a rotatable metering roller a peripheral surface contacting the upstream side of the peripheral surface of said form roller in the ink furnishing, and having a uniformly distributed large number of free recesses on a peripheral surface thereof for receiving the ink;

doctor means for removing an extra amount of ink from the peripheral surface of said metering roller at a position upstream of the contacting position of said form roller, said doctor means having switching means for switching the position between a contacting position where said doctor means is in contact with said metering roller for effecting removal of the extra amount of the ink and a released position where said doctor means is shifted away from the metering roller;

a rider roller rotating with contacting with the peripheral surface of said metering roller at the downstream side of the contacting position between said form roller and said metering roller;

an ink fountain opposing to the upper portion of said doctor means and opened at the front side and the upper side, and constituted of both side plates and tilted base;

a fountain roller having a peripheral surface located at a position for blocking the opened front side of said ink fountain and positioned adjacent to front edge of said ink fountain via a first gap, and positioned adjacent to the peripheral surface of said metering roller at an upstream position from the contacting position of said doctor means and said metering roller, and intermediate between the contacting position of said rider roller and the contacting position of said doctor means, via a second gap which is smaller than said first gap, and the peripheral surface of said fountain roller blocking the front side of said ink fountain and rotatable downwardly at a peripheral speed lower than the peripheral speed of said metering roller; and first gap adjusting means separately provided in said ink fountain for respective of divided zones defined along an axial direction of said fountain roller for adjusting said first gap, said apparatus having means selectively operable in:

an entire surface ink furnishing mode, in which said first gap is held fully opened, said doctor means is placed in contact with said metering roller, ink drawn through said fully opened first gap in a thickness corresponding to said first gap by rotation of said fountain roller, is furnished in an excess amount of ink onto the peripheral surface of said metering roller, with compression by passing through the second gap, the extra amount of ink on the peripheral surface is scraped off by means of said doctor means contacting with the peripheral surface of said metering roller to return to said ink fountain, and the ink is furnished onto a printing plate on the plate cylinder via the peripheral surface of said form roller in substantially uniform amount over the entire position along the axis of said metering roller, and a local ink furnishing mode in which said first gap is adjusted to be narrower with respect to the divided zones by the adjusting means, said doctor means is released away from the peripheral surface of said metering roller, the ink drawn from said ink fountain by rotation of said fountain roller per each divided zone in the desired thickness is furnished on the peripheral surface of said metering roller in the amount corresponding to the thickness of the ink at each zone passed through said gap, and, the ink furnished on the peripheral surface of said metering roller is transferred to the printing plate on said plate cylinder via the peripheral surface of said form roller.

3. An ink furnishing apparatus as set forth in claim 1 or 2, wherein said free recesses of said metering roller comprise regularly provided cavities on the peripheral surface.

4. An ink furnishing apparatus as set forth in claim 1 or 2, wherein said fine recesses of said metering roller comprise cavities opening hollow portions an the peripheral surface formed by uniformly dispersing in an outer peripheral layer.

5. An ink furnishing apparatus as set forth in claim 1 or 2, wherein said doctor means is a doctor blade.

6. An ink furnishing apparatus as set forth in claim 1 or 2, wherein said doctor means is a doctor bar.

7. An ink furnishing apparatus as set forth in claim 1 or 2, wherein said doctor means is a doctor roller having means adapted to rotate said doctor roller at lower peripheral speed than a peripheral speed of said metering roller.

8. An ink furnishing apparatus as set forth in claim 1 or 2, wherein said doctor means is a doctor roller rotating said doctor roller in a direction where the peripheral surface of the doctor roller displaces in an opposite direction to the displacement of the peripheral surface of said metering roller.

9. An ink furnishing apparatus as set forth in claim 2, which further comprises another rotatable roller contacting the peripheral surface of said rider roller.

10. An ink furnishing apparatus for a printing press for performing printing by furnishing an ink to a printing plate on a plate cylinder, comprising:

a form roller rotating in contact with a peripheral surface of the printing plate;

a rotatable metering roller having a peripheral surface contacting the upstream side of the peripheral surface of said form roller in the ink furnishing, and having a uniformly distributed large number of fine recesses on a peripheral surface thereof for receiving the ink;

doctor roller rotating with contacting with the peripheral surface upstream of said form roller in ink furnishing, and having means for selectively switching between rotation for scraping the ink off the peripheral surface of said metering roller and not scraping the ink;

an ink fountain opposing to the upper portion of said doctor roller and opened at the front side and the upper side, and constituted of both side plates and tilted base;

a fountain roller having a peripheral surface located at a position for blocking the opened front side, of said ink fountain and, positioned adjacent to a front edge of said ink fountain via a first gap, and positioned adjacent to the peripheral surface of said metering roller at an upstream position from the contacting position of said doctor roller via a second gap which is smaller than said first gap, and the peripheral surface fountain roller blocking the front side of said ink fountain and rotatable downwardly at a peripheral speed lower than the peripheral speed of said metering roller; and first gap adjusting means separately provided in said ink fountain for respective adjustment of divided zones defined along an axial direction of said fountain roller for adjusting said first gap, said apparatus having means selectively operable in:

an entire surface ink furnishing mode, in which said first gap is held fully opened, said doctor roller is placed in rotation for scraping off the ink from the peripheral surface of said metering roller, ink drawn through said fully opened first gap in a thickness corresponding to said first gap by rotation of said fountain roller, is furnished in an excess mount of ink onto the peripheral surface of said metering roller, with compression by passing through the second gap, the extra amount of ink on the peripheral surface is scraped off by means of said doctor roller rotating for scraping off the ink from the peripheral surface of said metering roller to return to said ink fountain, and the ink is furnished onto a printing plate on the plate cylinder via the peripheral surface of said form roller in substantially uniform amount over the entire position along the axis of said metering roller, and a local ink furnishing mode, in which said first gap is adjusted to be narrower with respect to the divided zones by the adjusting means, said doctor roller is rotated not to scrape off the ink from the peripheral surface of said metering roller, the ink drawn from said ink fountain by rotation of said fountain roller per each divided zones in the desired thickness is furnished on the peripheral surface of said metering roller in the amount corresponding to the thickness of the ink at each zone passed through said second gap, and the ink furnished on the peripheral surface of said metering roller is transferred to the printing plate on said plate cylinder via the peripheral surface of said form roller.

11. An ink furnishing apparatus for a printing press for performing printing by furnishing an ink to a printing plate on a plate cylinder, comprising:

a form roller rotating in contact with a peripheral surface of the printing plate;

a rotatable metering roller a peripheral surface contacting the upstream side of the peripheral surface of said form roller in the ink furnishing, and having a uniformly distributed large number of fine recesses on a peripheral surface thereof for receiving the ink;

doctor roller rotating with contacting with the peripheral surface upstream of said form roller in ink furnishing, and having means for selectively switching between rotation for scraping the ink off the peripheral surface of said metering roller and not scraping the ink;

a rider roller rotating with contacting with the peripheral surface of said metering roller at the downstream side of the contacting position between said form roller and said metering roller;

an ink fountain opposing to the upper portion of said doctor roller and opened at the front side and the upper side, and constituted of both side plates and tilted base;

a fountain roller having a peripheral surface located at a position for blocking the opened front side of said ink fountain and, positioned adjacent to a front edge of said ink fountain via a first gap, and positioned adjacent to the peripheral surface of said metering roller, at an upstream position from the contacting position of said doctor roller and intermediate between the contacting position of said rider roller and the contacting position of said doctor rollers via a second gap which is smaller than said first gap, and the peripheral surface of said fountain roller blocking the front side of said ink fountain rotatable downwardly at a peripheral speed lower than the peripheral speed of said metering roller; and first gap adjusting means separately provided in said ink fountain for respective of divided zones defined along an axial direction of said fountain roller for adjusting said first gap, said apparatus having means selectively operable in:

an entire surface ink furnishing mode, in which said first gap is held fully opened, said doctor roller is placed in rotation for scraping off the ink from the peripheral surface of said metering roller, ink drawn through said fully opened first gap in a thickness corresponding to said first gap by rotation of said fountain roller, is furnished in an excess amount of ink onto the peripheral surface of said metering roller, with compression by passing through the second gap, the extra amount of ink on the peripheral surface is scraped off by means of said doctor roller rotating for scraping off the ink from the peripheral surface of said metering roller to return to said ink fountain, and the ink is furnished onto a printing plate on the plate cylinder via the peripheral surface of said form roller in substantially uniform amount over entire position along the axis of said metering roller, and a local ink furnishing mode in which said first gap is adjusted to be narrower with respect to the divided zones by the adjusting means, said doctor roller is rotated not to scrape off the ink from the peripheral surface of said metering roller, the ink drawn from said ink fountain by rotation of said fountain roller per each divided zone in the desired thickness is furnished /on the peripheral surface of said metering roller in the amount corresponding to the thickness of the ink at each zone passed through said second gap, and the ink furnished on the peripheral surface of said metering roller is transferred to the printing plate on said plate cylinder via the peripheral surface of said form roller.

12. An ink furnishing apparatus as set forth in claim 10 or 11, wherein said fine recesses of said metering roller comprise regularly provided cavities on the peripheral surface.

13. An ink furnishing apparatus as set forth in claim 10 or 11, wherein said fine recesses of said metering roller comprise cavities opening hollow portions on the peripheral surface formed by uniformly dispersing in an outer peripheral layer.

14. An ink furnishing apparatus as set forth in claim 10 or 11, wherein the rotation of said doctor roller when not scraping off the ink from the peripheral surface of said metering roller is in a idling rotation by a frictional force in contact with said metering roller.

15. An ink furnishing apparatus as set forth in claim 10 or 11, wherein the rotation of said doctor roller when not scraping off the ink from the peripheral surface of said metering roller includes means for rotating said doctor roller at a peripheral speed substantially equal to the peripheral speed of said metering roller in the same direction as the peripheral surface of said metering roller.

16. An ink furnishing apparatus as set forth in claim 10 or 11, wherein the rotation of said doctor roller when scraping the ink from the peripheral surface of said metering roller includes means for rotating said doctor roller at a peripheral speed which is lower than the peripheral speed of said metering roller.

17. An ink furnishing apparatus as set forth in claim 10 or 11, wherein the rotation of said doctor roller when scraping the ink from the peripheral surface of said metering roller includes means for rotating said doctor roller at a peripheral surface of the doctor roller in an opposite direction to the displacement of the peripheral surface of said metering roller.

18. An ink furnishing apparatus as set forth in claim 11, which further comprises another rotatable roller in contact with the peripheral surface of said rider roller.

* * * * *